US009690238B2

(12) United States Patent
Yoshimura

(10) Patent No.: US 9,690,238 B2
(45) Date of Patent: Jun. 27, 2017

(54) IMAGE HEATING APPARATUS AND IMAGE FORMING APPARATUS HAVING A CONTROLLER FOR EXECUTING A RUBBING PROCESS

(71) Applicant: CANON KABUSHIKI KAISHA, Tokyo (JP)

(72) Inventor: Tomohiko Yoshimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/048,403

(22) Filed: Feb. 19, 2016

(65) Prior Publication Data

US 2016/0170342 A1 Jun. 16, 2016

Related U.S. Application Data

(63) Continuation of application No. PCT/JP2014/073847, filed on Sep. 3, 2014.

(30) Foreign Application Priority Data

Sep. 3, 2013 (JP) ..... 2013-182049

(51) Int. Cl.
*G03G 15/20* (2006.01)

(52) U.S. Cl.
CPC ..... *G03G 15/2028* (2013.01); *G03G 15/2032* (2013.01)

(58) Field of Classification Search
CPC ..... G03G 2215/20
See application file for complete search history.

(56) References Cited

U.S. PATENT DOCUMENTS 7,430,392 B2 9/2008 Ito et al.
7,460,821 B2 * 12/2008 Ai ..... G03G 15/2025 399/328

(Continued)

FOREIGN PATENT DOCUMENTS

EP 1 887 440 A2 2/2008
JP 2007-199596 A 8/2007

(Continued)

OTHER PUBLICATIONS

International Search Report issued on Dec. 2, 2014 in PCT/JP2014/073847.

(Continued)

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image heating apparatus includes first and second rotatable members configured to form a nip for heating a toner image on a sheet; a rotatable rubbing member configured to rub an outer surface of the first rotatable member; and a contact-and-separation mechanism configured to move the rotatable rubbing member toward and away from the first rotatable member. When the contact-and-separation mechanism executes a rubbing process, the contact-and-separation mechanism repeatedly executes alternately a first process for contacting the rotatable rubbing member with the first rotatable member and a second process for spacing the rotatable rubbing member from the first rotatable member.

20 Claims, 21 Drawing Sheets

(56) References Cited

U.S. PATENT DOCUMENTS

| | | | | |
|---|---|---|---|---|
| 8,306,446 | B2 * | 11/2012 | Ito | G03G 15/2039 399/329 |
| 8,971,735 | B2 | 3/2015 | Yoshimura | |
| 2005/0185978 | A1 * | 8/2005 | Kemmochi | G03G 15/2017 399/69 |
| 2008/0038027 | A1 | 2/2008 | Ito et al. | |
| 2011/0176823 | A1 * | 7/2011 | Kameda | G03G 15/5029 399/45 |
| 2013/0058672 | A1 | 3/2013 | Takada et al. | |
| 2013/0164054 | A1 * | 6/2013 | Hayashi | G03G 15/2025 399/329 |
| 2013/0308966 | A1 | 11/2013 | Masuda et al. | |
| 2014/0318931 | A1 | 10/2014 | Takematsu et al. | |

FOREIGN PATENT DOCUMENTS

| | | | |
|---|---|---|---|
| JP | 2008-40363 | A | 2/2008 |
| JP | 2013-15631 | A | 1/2013 |
| JP | 2013-88498 | A | 5/2013 |
| JP | 2013-242398 | A | 12/2013 |

OTHER PUBLICATIONS

U.S. Appl. No. 14/844,387, filed Sep. 3, 2015.
U.S. Appl. No. 15/049,496, filed Feb. 22, 2016.
European Search Report issued in corresponding European Application No. 14841890.8 dated Mar. 23, 2017.

* cited by examiner

IMAGE HEATING APPARATUS AND IMAGE FORMING APPARATUS HAVING A CONTROLLER FOR EXECUTING A RUBBING PROCESS

TECHNICAL FIELD

The present invention relates to an image heating apparatus for heating a toner image on a sheet and an image forming apparatus including the image heating apparatus. As this image forming apparatus, it is possible to cite a copying machine, a printer, FAX and a multi-function machine or the like having a plurality of functions of these machines.

BACKGROUND ART

Conventionally, in the image forming apparatus using an electrophotographic type, a fixing device for fixing the toner image, formed on a recording material (sheet), at a nip between two fixing members (first and second rotatable fixing members) is mounted.

In such a fixing device, with repetition of a fixing process, the fixing member is abraded by an edge portion (both end portions with respect to a direction perpendicular to a recording material feeding direction) of the recording material, so that a surface property thereof has a tendency that the surface property is deteriorated compared with the surface property in another region. Specifically, there is a tendency that a surface of the fixing member in a region contacting the edge portion of the recording material is roughened. When the surface property of such a fixing member becomes non-uniform, the surface property appears on a fixed image, so that there is a liability that glossiness of an image is not uniform.

Therefore, in a fixing device described in Japanese Laid-Open Patent Application 2008-040363, a roughening roller (rotatable rubbing member) for rubbing the surface of the fixing member is provided. Specifically, the fixing member is rubbed with the roughening roller, whereby a deteriorated state (surface roughness) of a portion thereof contacting the edge portion of the recording material is made inconspicuous compared with another portion.

According to study by the present inventor, it was found that during a rubbing process, shavings (cuttings) by the roughening roller stagnate between the roughening roller and the fixing member and rubbing power lowers due to the stagnation of the shavings. When such a situation generates, it becomes difficult to efficiently restore the surface property of the fixing member, so that there is room for improvement.

SUMMARY OF THE INVENTION

An object of the present invention is to suppress a lowering in rubbing power by a rotatable rubbing member.

According to an aspect of the present invention, there is provided an image heating apparatus comprising: first and second rotatable members configured to form a nip for heating a toner image on a sheet; a rotatable rubbing member configured to rub an outer surface of the first rotatable member; and a contact-and-separation mechanism configured to move the rotatable rubbing member toward and away from the first rotatable member, wherein when the contact-and-separation mechanism executes a rubbing process, the contact-and-separation mechanism repeatedly executes alternately a first process for contacting the rotatable rubbing member with the first rotatable member and a second process for spacing the rotatable rubbing member from the first rotatable member.

According to another aspect of the present invention, there is provided an image forming apparatus comprising: an image forming portion configured to form a toner image on a sheet; first and second rotatable members configured to form a nip for heating the toner image formed on the sheet by the image forming portion; a rotatable rubbing member configured to rub an outer surface of the first rotatable member; and a contact-and-separation mechanism configured to move the rotatable rubbing member toward and away from the first rotatable member; a counting portion configured to count a number of times of image formation; and an executing portion configured to execute a rubbing process by the rotatable rubbing member depending on an output of the counting portion, wherein when the executing portion causes the contact-and-separation mechanism to execute the rubbing process, the executing portion causes the contact-and-separation mechanism to repeatedly execute alternately a first process for contacting the rotatable rubbing member with the first rotatable member and a second process for spacing the rotatable rubbing member from the first rotatable member.

Effect of the Invention

According to the present invention, in the image heating apparatus and the image forming apparatus in which the rotatable rubbing member is used, it is possible to suppress the lowering in rubbing power due to an image heating operation.

EMBODIMENTS FOR CARRYING OUT THE INVENTION

Preferred embodiments for carrying out the present invention will be exemplarily described in detail using the drawings below.

First Embodiment (Image Forming Apparatus)

Figure 2:
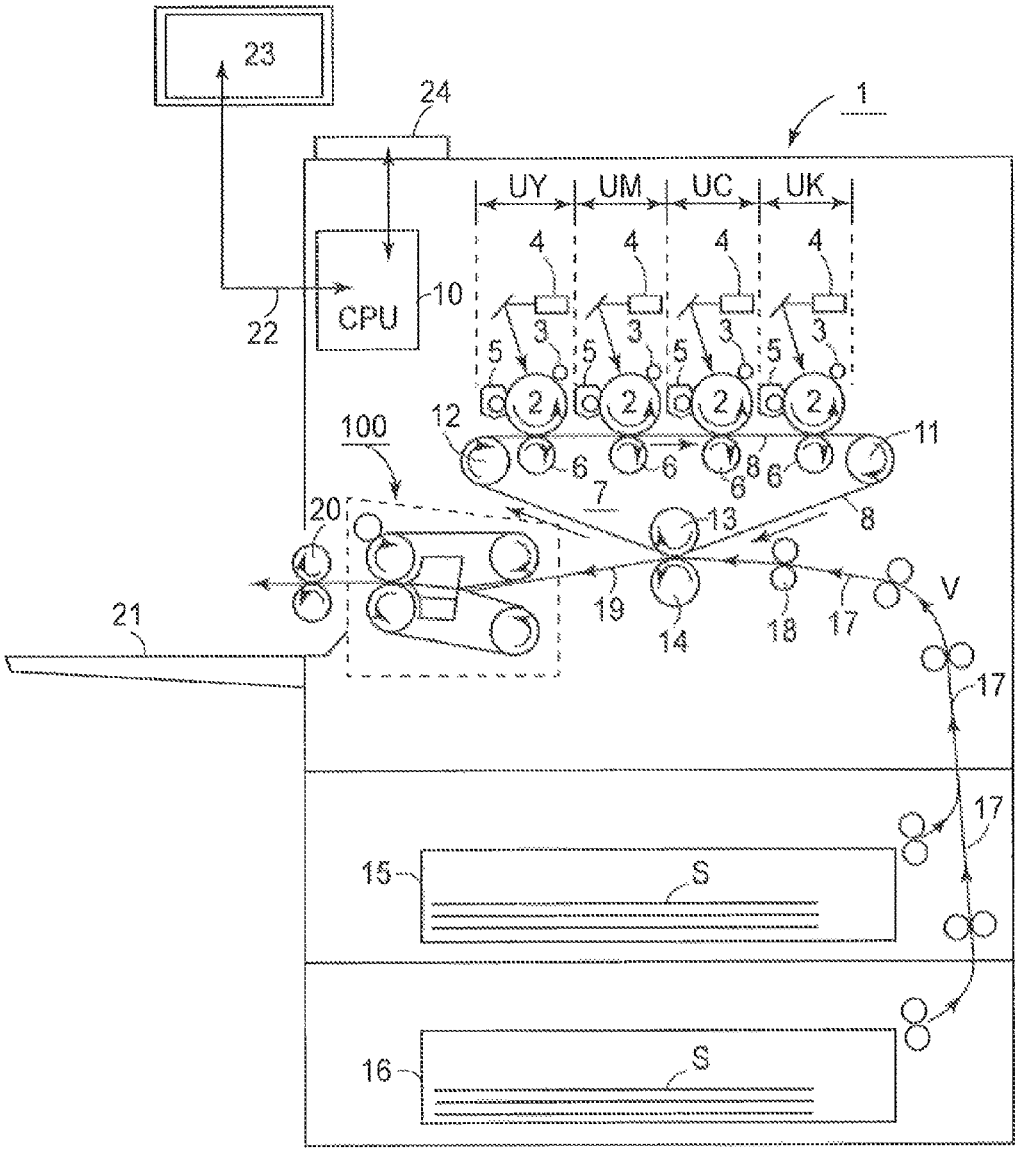
FIG. 2 is a sectional view for illustrating an image forming apparatus in which the fixing device is mounted.

FIG. 2 is a schematic structural view of an image forming apparatus 1 in this embodiment and is taken along a feeding direction V of a sheet (recording material) S. This image forming apparatus 1 is a full-color electrophotographic printer (hereinafter referred to as a printer) using an intermediary transfer member. This printer 1 is capable of forming an image corresponding to image data (electrical image information) inputted from an external host device 23 connected with a printer controller (hereinafter referred to as CPU) 10 via an interface 22 and capable of outputting an image-formed product.

The CPU (controller) 10 is a control means for effecting integrated control of an operation of the printer 1, and transfers various electrical information signals between itself and the external host device 23 or a printer operating portion 24. Further, the CPU 10 effects processing of the electrical information signals inputted from various process devices and sensors and the like, processing of instruction (command) signals sent to the various process devices, predetermined initial sequence control and predetermined image forming sequence control. The external host device 23 may be, e.g., a personal computer, a network, an image reader, a facsimile machine, and the like.

Inside the printer 1, an image forming portion for forming toner images on the sheet (recording material) S is provided. Specifically, as the image forming portion, four image forming stations U (UY, UM, UC, UK) are juxtaposed. The respective image forming stations U are the same electrophotographic image forming mechanism which are the same in constitution only except that the colors of toners as developers accommodated in developing devices 5 are yellow (Y), magenta (M), cyan (C) and black (K) which are different from each other.

That is, each of the image forming stations U includes an electrophotographic photosensitive member (hereinafter referred to as a drum) and includes, as process device acting on the drum 2, a charging roller 3, a laser scanner 4, the developing device 5, a primary transfer roller 6, and the like.

The drum 2 of each image forming station U is rotationally driven in the counterclockwise direction indicated by an arrow at a predetermined speed. Then, on the drum 2 of the first image forming station UY, a toner image of Y corresponding to a Y component image for a full-color image to be formed is formed. On the drum 2 of the second image forming station UM, a toner image of M corresponding to an M component image is formed. Further, on the drum 2 of the third image forming station UC, a toner image of C corresponding to a C component image is formed. On the drum 2 of the fourth image forming station UK, a toner image of K corresponding to a K component image is formed. As a toner image forming process on the drums 2 of the respective image forming stations U, an electrophotographic process is used and will be omitted from further detailed description.

On a lower side of the respective image forming stations U, an intermediary transfer belt unit 7 is provided. This unit 7 includes a flexible endless intermediary transfer belt 8 as an intermediary transfer member. The belt 8 is extended and stretched among three rollers consisting of a driving roller 11, a tension roller 12 and a secondary transfer opposite roller 13. The belt 8 is circulated and moved in the clockwise direction indicated by an arrow at a speed corresponding to the rotational speed of the drums 2 by driving the driving roller 11. The secondary transfer opposite roller 13 is contacted to the belt 8 toward a secondary transfer roller 14 at predetermined pressure (urging force). A contact portion between the belt 8 and the secondary transfer roller 14 is a secondary transfer nip.

The primary transfer rollers 6 of the image forming stations U are provided inside the belt 8 and are contacted to the belt 8 toward lower surfaces of the drums 2. At each image forming station U, a contact portion between the drum 2 and the belt 8 is a primary transfer nip. To the primary transfer roller 6, a predetermined primary transfer bias is applied at predetermined control timing.

The toner images of Y, M, C and K formed on the drums 2 of the image forming station U are successively primary-transferred superposedly at the primary transfer portions onto the surface of the belt 8 which is circulated and moved. As a result, an unfixed full-color toner image including the superposed four color toner images is synthetically formed on the belt 8 and is conveyed to the secondary transfer nip.

On the other hand, sheets (recording material) S accommodated in a first sheet feeding cassette 15 or a second sheet feeding cassette 16 are separated one by one by an operation of a sheet feeding mechanism, and then the separated sheet S is passed through a feeding path 17 to be sent to a registration roller pair 18. The registration roller pair 18 once receives and stops the sheet S, and corrects, in the case where the sheet S is obliquely moved, the sheet S to a straight movement state. Then, the registration roller pair 18 feeds the sheet S to the secondary transfer nip in synchronism with the toner image on the belt 8.

In a period in which the sheet S is nipped and fed at the secondary transfer nip, to the secondary transfer roller 14, a predetermined secondary transfer bias is applied. As a result, the full-color toner image is collectively secondary-transferred from the belt 8 onto the sheet S. Then, the sheet S coming out of the secondary transfer nip is separated from the surface of the belt 8 and is passed through a feeding path 19 to be guided into a fixing device 100 functioning as an image heating apparatus. The sheet S is heated and pressed in the fixing device 100, so that the unfixed toner image on the sheet is fixed as a fixed image. The sheet S coming out of the fixing device 100 is fed and discharged, as a full-color image-formed product, onto a discharge tray 21 by a discharging roller pair 20.

(Fixing Device 100)

Figure 3:
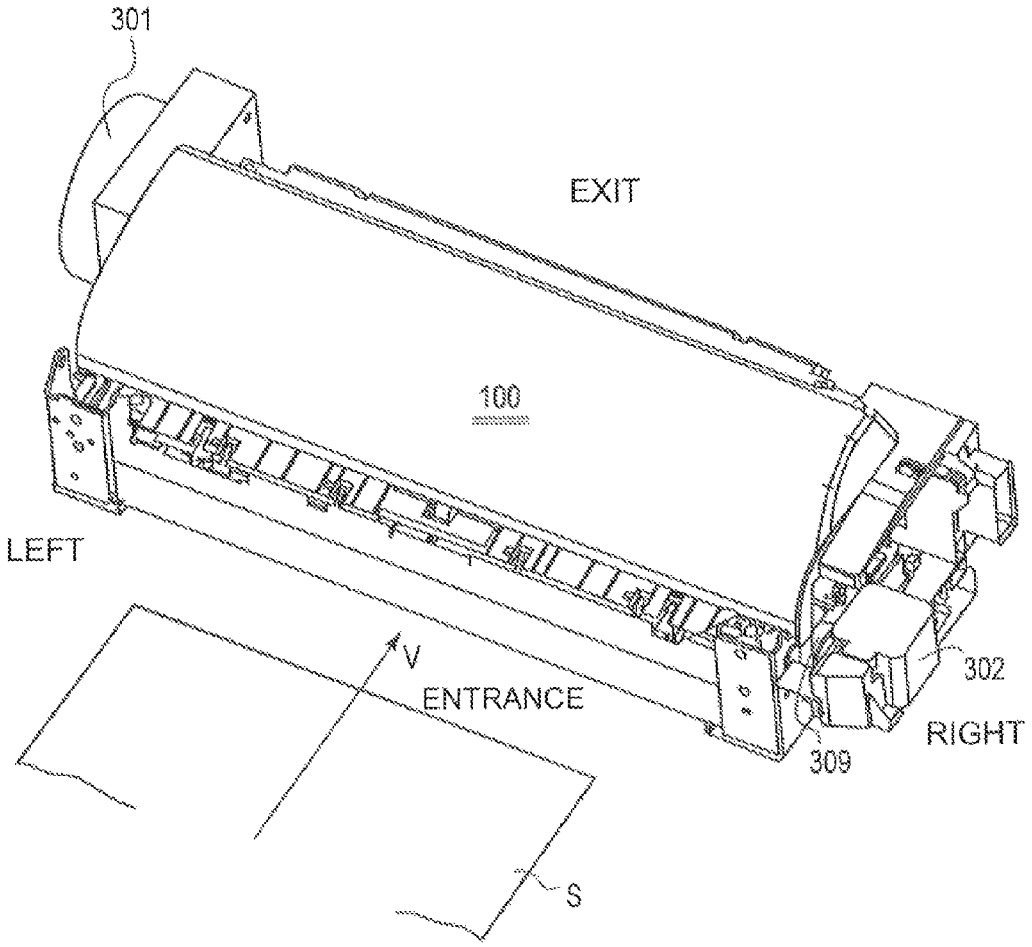
FIG. 3 is a perspective view of an outer appearance of the fixing device.
Figure 4:
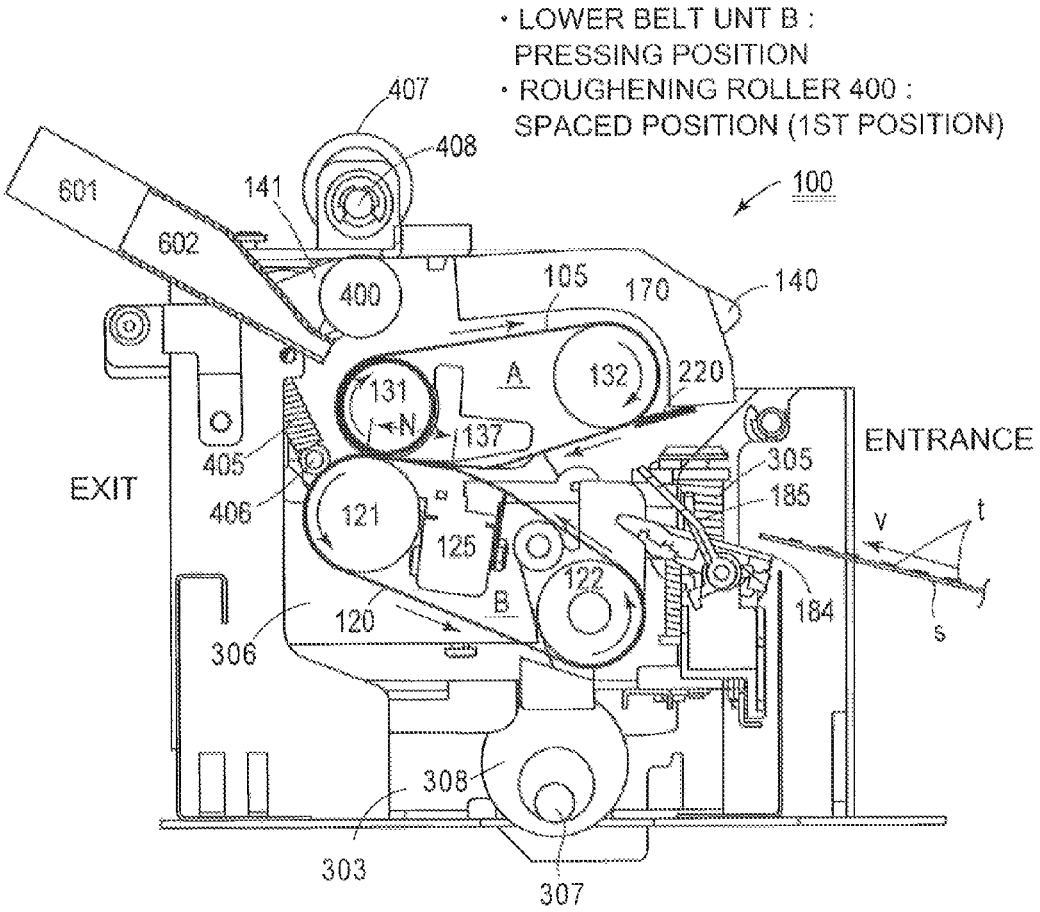
FIG. 4 is a left side view (during the pressing state of the lower-side belt assembly B) of the principal part of the fixing device.
Figure 5:
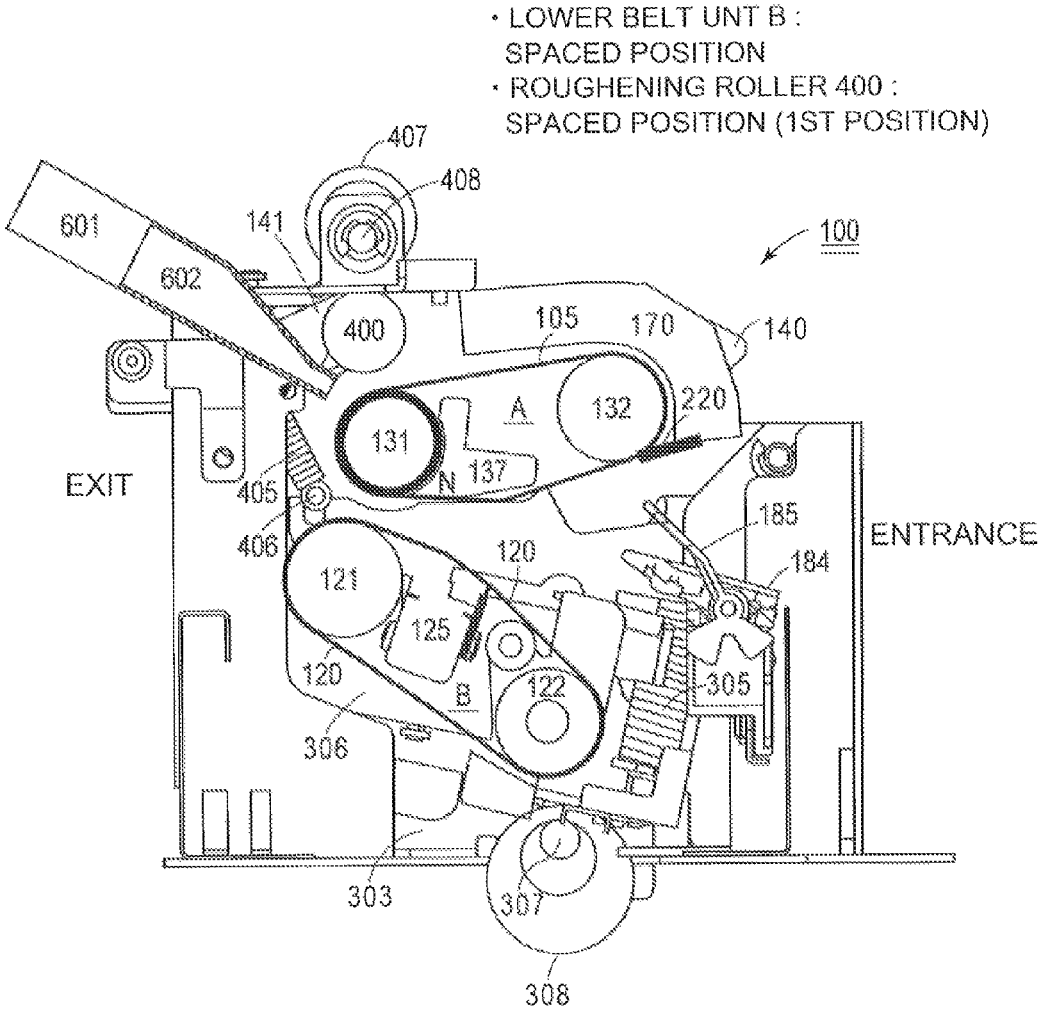
FIG. 5 is a left side view (during a spaced state of the lower-side belt assembly B) of the principal part of the fixing device.
Figure 6:
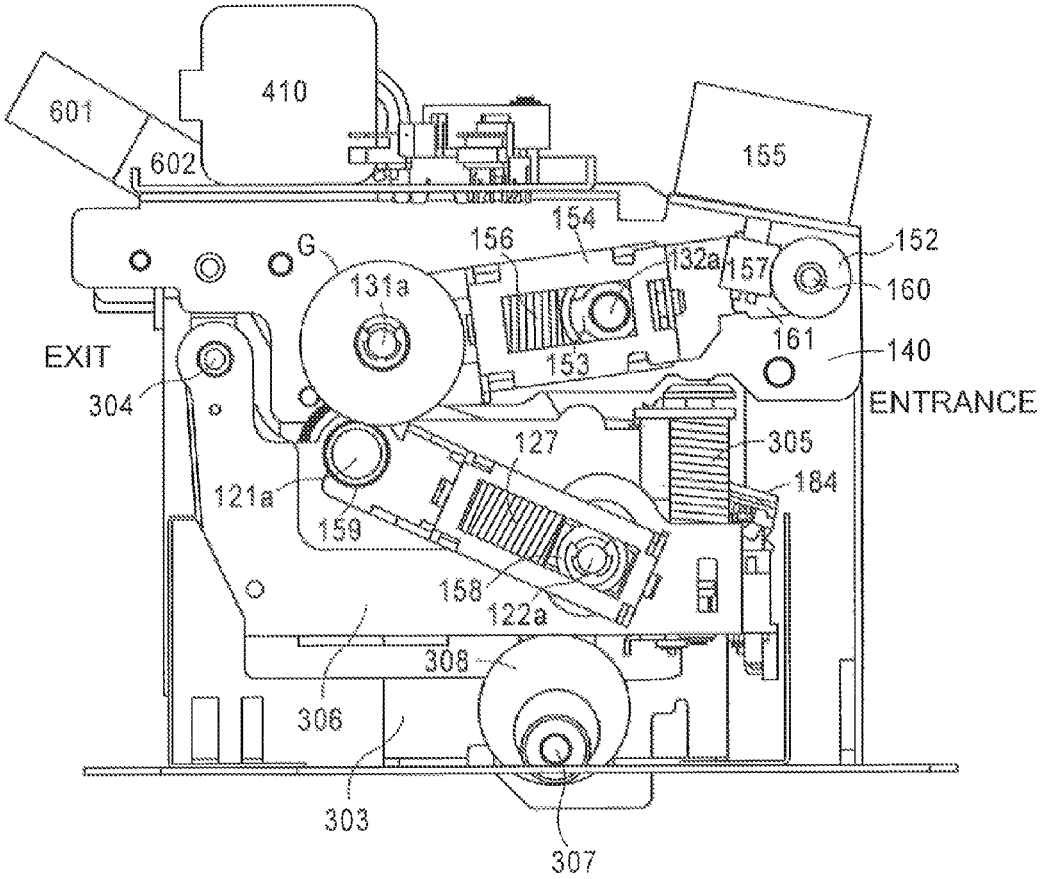
FIG. 6 is a left side view (during the pressing state of the lower-side belt assembly B) of the principal part of the fixing device.
Figure 7:
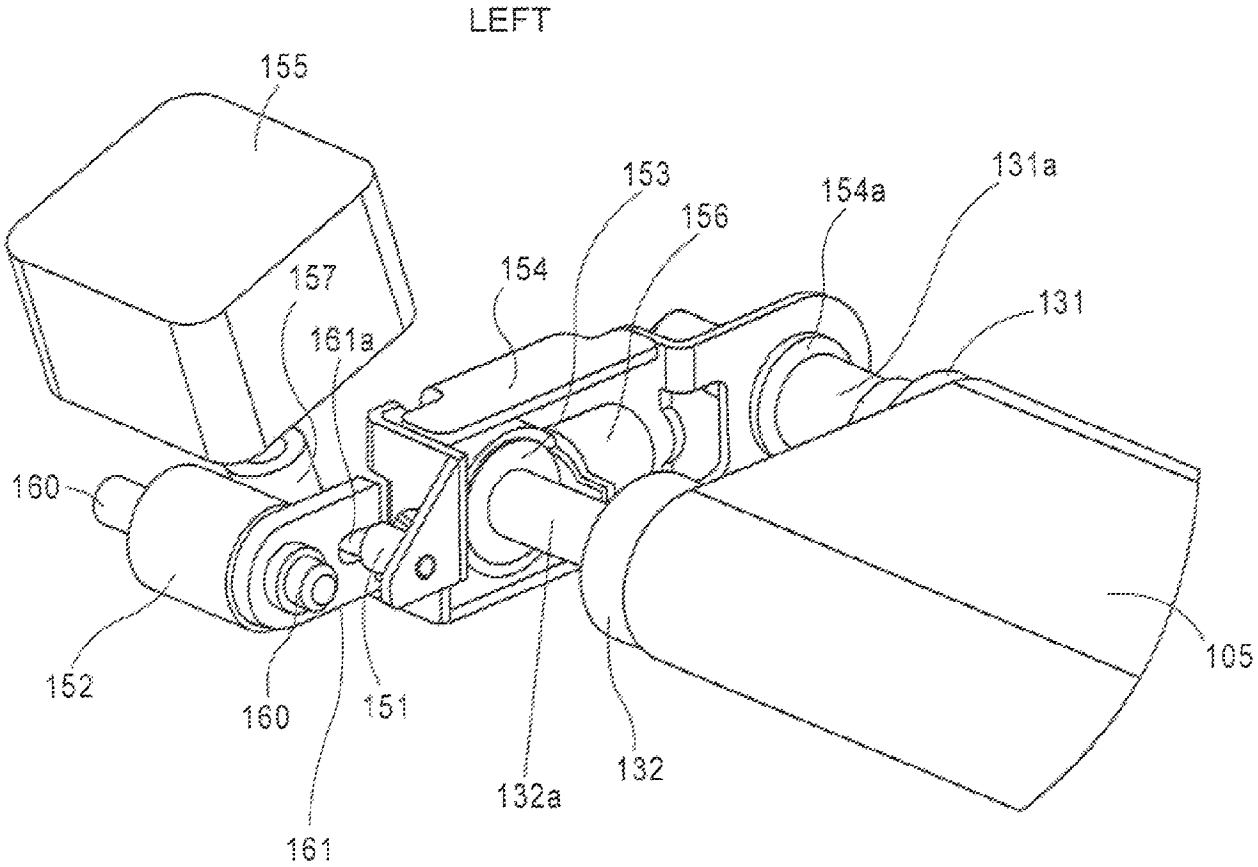
FIG. 7 is a perspective view of a belt shift control mechanism portion of the fixing device.

FIG. 3 is a perspective view of an outer appearance of the fixing device 100 functioning as an image heating apparatus. FIG. 4 is a cross-sectional left side view of a principal portion of the image forming apparatus 100 and shows an urged state of a lower-side belt assembly B. FIG. 5 is a cross-sectional right side view of a principal part of the device 100 and shows a pressure-eliminated state of the lower-side belt assembly B. FIG. 6 is a left side view of the principal part of the device 100 and shows a pressed state of the lower-side belt assembly B. FIG. 7 is a perspective view of a belt shift control mechanism portion.

Here, with respect to the fixing device 100 or members constituting the fixing device 100, a longitudinal direction (longitudinal) or a widthwise direction (width) is a direction (or a dimension in the direction) parallel to a direction perpendicular to a feeding direction V of the sheet S shown in FIG. 2 in a sheet feeding path plane of the fixing device. A short direction (short) is a direction (or a dimension in the direction) parallel to the sheet feeding direction V in the sheet feeding path plane of the fixing device.

Further, with respect to the fixing device 100, a front surface (side) is a surface on a sheet entrance side, and a rear surface (side) is a surface on a sheet exit side, and left or right are left or right when the device is viewed from the front surface. In this embodiment, the right side is a front side, and the left side is a rear side. Upper side (up) and lower side (down) are those with respect to the direction of gravitation. Upstream side and downstream side are those with respect to the sheet feeding direction V. A width of the belt or the sheet is a dimension with respect to a direction perpendicular to the sheet feeding direction. Here, the fixing device 100 in this embodiment is an image heating apparatus of a twin belt nip type, an electromagnetic induction heating (IH) type and an oil-less fixing type.

The fixing device 100 includes an upper-side belt assembly A as a heating unit and a lower-side belt assembly B as a pressing unit in which each of belts is driven by a motor 301 (FIG. 2). Further, the fixing device 100 includes a pressing-spacing mechanism for the lower-side belt assembly B driven by a motor 302 (FIG. 2) relative to the upper-side belt assembly A. Further, the fixing device 100 includes an IH heater (a coil for generating magnetic flux for effecting electromagnetic induction heating) 170, is a heating portion for heating the fixing belt 105 in the upper-side belt assembly A, a shift control mechanism for the fixing belt 105, and a roughening mechanism (surface property refreshing mechanism) for restoring the surface property of the fixing belt 105. In the following, these members will be sequentially described.

1) Upper-Side Belt Assembly A and IH Heater 170

In FIG. 4, the upper-side belt assembly A is provided between left and right upper-side plates 140 (specifically in FIG. 1A) of a device casing. This assembly A includes a parting layer at its surface and includes a flexible fixing belt (endless belt) 105 as a rotatable fixing member (fixing member). Further, the assembly A includes, as a plurality of belt supporting members (supporting rollers) for stretching the fixing belt 105 as a first rotatable fixing member, a driving roller 131, a steering roller 132 also functioning as a tension roller and a pad stay 137.

The driving roller 131 is provided between the left and right upper-side plates 140 on the sheet exit side, and as shown in FIG. 7, left and right shaft portions 131*a* are rotatably supported between the left and right upper-side plates 140 via bearings (not shown). Further, on each of the outsides of the left and right upper-side plates 140, a steering roller supporting arm 154 is provided and extended from the driving roller 131 side to the sheet entrance side.

The right-side supporting arm 154 (not shown) is fixed to the upper-side plate 140 (not shown). Referring to FIG. 7, the left-side supporting arm 154 is supported by the left-side shaft 131*a* of the driving roller 131 via a bearing 154*a* and is swingable about the shaft 131*a* in an up-down direction. At a free end portion of the left-side supporting arm 154, a pin 151 is provided. At an outer surface of the upper-side plate 140, a shaft 160 is provided on the sheet entrance side.

By this shaft 160, a worm wheel (helical gear) 152 provided integrally with a fork plate 161 having a U-shaped groove portion 161*a* is rotatably supported. The pin 151 of the left-side supporting arm 154 engages with the groove portion 161*a* of the fork plate 161. Here, the upper-side plate 140 is provided with a stepping motor 155, and a worm 157 fixed on a rotation shaft of this stepping motor 155 engages with the worm wheel 152.

By normally driving or reversely driving the stepping motor 155, the fork plate 161 is rotationally moved in an upward direction or a downward direction via the worm 157 and the worm wheel 152. In interrelation with this, the left-side arm 154 is rotationally moved about the shaft 131*a* in the upward direction or the downward direction.

Then, the steering roller 132 is provided in the sheet entrance side between the left and right upper-side plates 140, and left and right shaft portions 132*a* thereof are rotatably supported by the above-described left and right supporting arms 154, respectively, via bearings 153. The bearing 153 is supported slidably and movably in a belt tension direction relative to the supporting arm 154 and is moved and urged in a spacing direction from the driving roller 131 by a tension spring 156.

In FIG. 4, the pad stay 137 is a member formed of, e.g., stainless steel (SUS material). This pad stay 137 is fixed and supported between the left and right upper-side plates 140 at its left and right end portions so that the pad stay 137 is located inside the fixing belt 105 and closely to the driving roller 131 between the driving roller 131 and the steering roller 132, a pad receiving surface facing downward.

The fixing belt 105, which is extended around the driving roller 131, the steering roller 132 and the pad stay 137, under application of a predetermined tension (tensile force) by movement of the steering roller 132 in the belt tension direction by an urging force of the tension spring 156. In this embodiment, the tension of 200N is applied. Further, a lower-side belt portion of the fixing belt 105 is contacted at its inner surface to the downward pad receiving surface of the pad stay 137.

As the fixing belt 105, any belt may be appropriately selected so long as the belt can be heated by the IH heater 170 and has heat resistance. For example, a belt prepared by coating a 300 μm-thick silicone rubber on a magnetic metal layer, such as a nickel layer or a stainless steel layer, of 75 μm in thickness, 380 mm in width and 200 mm in circumference and then by coating a PFA tube as a surface layer (parting layer) on the silicone rubber is used as the fixing belt 105.

The driving roller 131 is, e.g., a roller formed by integrally molding a heat-resistant silicone rubber elastic layer on a surface layer of a solid core metal formed of stainless steel in outer diameter of 18 mm. The driving roller 131 is provided in the sheet exit side in a nip region of the fixing nip N formed between the fixing belt 105 and a pressing belt 120 as a second rotatable member described later, and its elastic layer is elastically distorted in a predetermined amount by press-contact of the pressing roller 121 described later.

Here, in this embodiment, the driving roller 131 and the pressing roller 121 form a nip shape, formed by sandwiching the fixing belt 105 and the pressing belt 121 therebetween, in a substantially straight shape. However, in order to control buckling of the sheet S due to a speed difference of the sheet S in the fixing nip N, it is also possible to form various crown shapes of the rollers in such a manner that the crown shapes of the driving roller 131 and the pressing roller 121 are intentionally formed as a reverse-crown shape or the like.

The steering roller 132 is, e.g., a hollow roller formed of stainless steel so as to have an outer diameter of 20 mm and an inner diameter of about 18 mm. This steering roller 132 functions as a tension roller which stretches the fixing belt 105 to apply tension to the fixing belt 105. In addition, the steering roller 132 functions as a roller (steering roller) for adjusting meandering of the fixing belt 105 in the widthwise direction perpendicular to a movement direction of the fixing belt 105 by being controlled in slope by a shift control mechanism described later.

To the driving roller 131, a drive input gear G (FIG. 1B) is coaxially provided and fixed on a left end side of the belt shaft 131*a*. To this gear G, drive input from the driving motor 301 (FIG. 3) is made via a drive transmission means (not shown), so that the driving roller 131 is rotationally driven in the clockwise direction, indicated by an arrow in FIG. 4, at a predetermined speed.

By the rotation of the driving roller 131, the fixing belt 105 is circulated and fed in the clockwise direction indicated by the arrow at a speed corresponding to the speed of the driving roller 131. The steering roller 132 is rotated by the circulation feeding of the fixing belt 105. The inner surface of the lower-side belt portion of the fixing belt 105 slides and moves on the downward pad receiving surface of the pad stay 137, and in order to stably feed the sheet S to the fixing nip N described later, the drive (driving force) is transmitted with reliability between the fixing belt 105 and the driving roller 131.

Here, the IH heater 170 as a heating portion for heating the fixing belt 105 shown in FIG. 4 is an induction heating coil unit constituted by an exciting coil, a magnetic core, and a holder for holding these members, and the like. The IH heater 170 is disposed above the upper-side belt assembly A, and is fixed and disposed between the left and right upper-side plates 140 so that it extends from a portion of the upper surface of the fixing belt 105 to a portion of the steering roller 132 and opposes the fixing belt 105 in a non-contact manner with a predetermined gap therebetween.

The exciting coil of the IH heater 170 generates AC magnetic flux by being supplied with an AC current, and the AC magnetic flux is guided by the magnetic core to generate an eddy current in the magnetic metal layer of the fixing belt 105 as an induction heat generating member. The eddy current generates Joule heat by specific resistance of the induction heat generating member. The AC current to be supplied to the exciting coil is controlled so that a surface temperature of the fixing belt 105 is temperature-controlled at about 140° C. to about 200° C. (target temperature) on the basis of temperature information from a thermistor 220 for detecting the surface temperature of the fixing belt 105.

2) Lower-Side Belt Assembly B and Pressing-Spacing Mechanism

In FIG. 4, the lower-side belt assembly B is provided below the upper-side belt assembly A. This assembly B is assembled with a lower frame (urging frame) 306 (FIG. 6) rotatably supported in the vertical (up-down) direction about a hinge shaft 304 (FIG. 6) fixedly provided between left and right lower-side plates 303 in the sheet exit side in the fixing device 100.

In FIG. 4, this assembly B includes a flexible pressing belt (endless belt) 120 as a rotatable fixing member (pressing member) for forming the nip N between the pressing belt and the fixing belt 105. Further, the assembly B includes, as a plurality of belt stretching members for stretching the pressing belt 120 as a second rotatable member with tension, a pressing roller (pressing roller) 121, a tension roller 122 and a pressing pad 125.

The pressing roller 121 is rotatably supported at left and right shaft portions 121*a* thereof between the left and right side plates of the lower frame 306 via bearings 159 as shown in FIG. 6. The tension roller 122 is rotatably supported at left and right shaft portions 122*a* thereof by the left and right side plates via bearings 158. The bearing 158 is supported slidably and movably in the belt tension direction relative to the lower frame 306 and is urged by a tension spring 127 so as to move in a spacing direction from the pressing roller 121.

Returning to FIG. 4, the pressing pad 125 is a member formed with, e.g., a silicone rubber, and left and right end portions thereof are fixed and supported between the left and right side plates of the lower frame 306. The pressing roller 121 is located on the sheet exit side between the left and right side plates of the lower frame 306. On the other hand, the tension roller 122 is located on the sheet entrance side between the left and right side plates of the lower frame 306. The pressing pad 125 is non-rotationally supported and fixedly disposed so that the pad 125 is located inside the pressing belt 120 and closely to the pressing roller 121 between the pressing roller 121 and the tension roller 122 with a pad surface upward.

The pressing belt 120, which is extended around the pressing roller 121, the tension roller 122, the pressing pad 125, under application of a predetermined tension by movement of the tension roller 122 in the belt tension direction by an urging force of the tension spring 127. In this embodiment, the tension of 200N is applied. Here, an upper-side belt portion of the fixing belt 105 is contacted at its inner surface to the upward pad surface of the pressing pad 125.

As the pressing belt 120, any belt may be appropriately selected if the belt has heat resistance. For example, a belt prepared by coating a 300 μm-thick silicone rubber on a nickel layer of 50 μm in thickness, 380 mm in width and 200 mm in circumference and then by coating a PFA tube as a surface layer (parting layer) on the silicone rubber is used as the pressing belt 120. The pressing roller 121 is, e.g., a roller formed of a solid stainless steel in outer diameter of 20 mm, and the tension roller 122 is, e.g., a hollow roller formed of stainless steel so as to have an outer diameter of 20 mm and an inner diameter of about 18 mm.

Here, the lower-side belt assembly B is rotation-controlled about the hinge shaft 304 in the up-down direction by the pressing-spacing mechanism as a contact-and-separation means. That is, the lower-side belt assembly B is raised and rotationally moved by the pressing-spacing mechanism and thus is moved to a pressing position as shown in FIG. 4, while the lower-side belt assembly B is moved to a spaced position as shown in FIG. 5 by being raised and rotationally moved.

Further, the lower-side belt assembly B is moved to the pressing position, and thus is placed in the following state. That is, the pressing roller 121 and the pressing pad 125 are press-contacted to the pressing belt 120 toward the driving roller 131 and the pad stay 137 of the upper-side belt assembly A via the fixing belt 105. As a result, between the fixing belt 105 of the upper-side belt assembly A and the pressing belt 120 of the lower-side belt assembly B, the fixing nip N having a predetermined width with respect to the feeding direction V of the sheet S is formed. Further, the lower-side belt assembly B is moved to the spaced position, so that the pressing thereof against the upper-side belt assembly A is eliminated and the lower-side belt assembly B is spaced in a non-contact state.

Here, the above-described pressing-spacing mechanism in this embodiment will be described. In FIG. 6, a lower frame 306 is provided, on an opposite to the hinge shaft 304 side, with a pressing spring 305 for causing the lower-side belt assembly B to elastically press-contact the upper-side belt assembly A.

At a lower portion between the left and right lower-side plates 303, a pressing cam shaft 307 is rotatably shaft-supported and disposed. On left and right sides of this pressing cam shaft 307, a pair of eccentric pressing cams 308, having the same shape and the same phase, for supporting a lower surface of the lower frame 306. On a right end side of the pressing cam shaft 307, a pressing gear 309 (FIG. 3) is coaxially fixed and disposed. To this gear 309, drive input is made from the pressing motor 302 via a drive transmitting means (not shown), so that the pressing cam shaft 307 is rotationally driven.

The pressing cam shaft 307 forms a first angular position of rotation where a largely protruded portion of the eccentric pressing cam 308 is directed upward as shown in FIGS. 4 and 6 and a second angular position of rotation where the largely protruded portion is directed downward as shown in FIG. 5.

The pressing cam shaft 307 is rotated to the first angular position of rotation and is stopped, so that the lower frame 306 on which the lower-side belt assembly B is mounted is raised by the largely protruded portion of the eccentric pressing cam 308. Then, the lower-side belt assembly B contacts the upper-side belt assembly A while compressing the pressing spring 305 of the pressing spring unit. As a result, the lower-side belt assembly B is pressed and urged elastically against the upper-side belt assembly A at a predetermined pressure (e.g., 400 N) by compression reaction force of the pressing spring 305, and is held at the pressing position.

Here, by the press-contact of the pressing roller 121 to the pressing belt 120 toward the driving roller 131, curvature deformation of about several hundreds of microns is generated on the driving roller 131 in a side opposite from the side where the driving roller 131 opposes the pressing roller 121. This curvature deformation of the driving roller 131 constitutes a factor of depressure at a longitudinal central portion of the fixing nip N. In order to eliminate this depressure, the driving roller 131 or both of the driving roller 131 and the pressing roller 121 are formed in a crown shape, so that a nip shape provided by the driving roller 131 and the pressing roller 121 is made substantially straight. In this embodiment, the driving roller 131 is formed in a normal crown shape of 300 μm.

Further, the pressing cam shaft 307 is rotated to the second angular position of rotation and is stopped, so that the largely protruded portion of the eccentric pressing cam 308 is directed downward and a small protruded portion corresponds to the lower surface of the lower frame to lower the lower-side belt assembly B. That is, the pressure of the lower-side belt assembly B to the upper-side belt assembly A is eliminated and is held at the spaced position from the upper-side belt assembly A in a non-contact and predetermined spaced manner as shown in FIG. 5.

Figure 8:
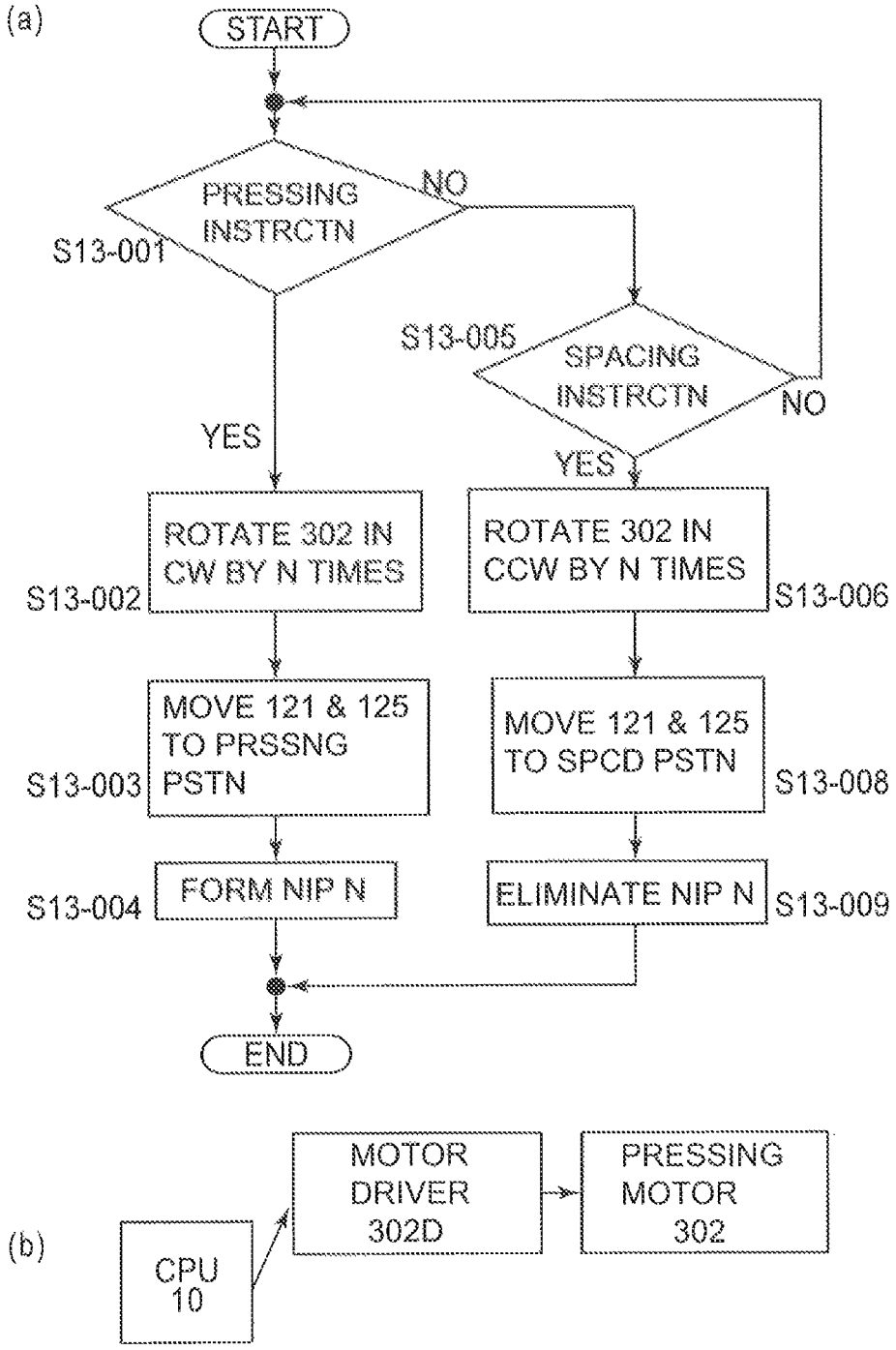
In FIG. 8, (a) is a flowchart of vertical movement control of the lower-side belt assembly B, and (b) is a block diagram of a control system.

Here, by a control flowchart of (a) of FIG. 8 and a block diagram of a control system of (b) of FIG. 8, vertical movement control of the lower-side belt assembly B will be described. The lower-side belt assembly B is usually held at the spaced position shown in FIG. 5. By a pressing instruction from the CPU 10 <S13-001>, the pressing motor 302 rotates in CW direction by N turns which is a predetermined number of rotation <S13-002>, so that the pressing cam shaft 307 is driven a half turn.

As a result, the eccentric pressing cam 308 is changed in angular position from the second angular position of rotation of FIG. 5 to the first angular position of rotation of FIGS. 4 and 6, so that the lower-side belt assembly B is raised and rotationally moved, and the pressing roller 121 and the pressing pad 125 move to the pressing position <S13-002>. That is, the pressing roller 121 and the pressing pad 125 press-contact the pressing belt 120 toward the driving roller 131 and the pad stay 137 of the upper-side belt assembly A via the fixing belt 105 at a predetermined contact pressure. As a result, between the fixing belt 105 and the pressing belt 120, the fixing nip N having a predetermined width with respect to the sheet feeding direction V is formed <S13-004>.

Further, in a state in which the lower-side belt assembly B is usually held at the spaced position shown in FIG. 5, by a pressing instruction from the CPU 10<S13-005>, the pressing motor 302 rotates in CCW direction by N turns which is a predetermined number of rotation <S13-006>. As a result, the pressing cam shaft 307 is driven a half turn, so that the eccentric pressing cam 308 is changed in angular position from the first angular position of rotation of FIGS. 4 and 6 to the second angular position of rotation of FIG. 5. That is, the lower-side belt assembly B is raised and rotationally moved, so that the pressing roller 121 and the pressing pad 125 move to the spaced position <S13-008>. As a result, the formation of the fixing nip N is eliminated <S13-009>.

3) Fixing Operation and Temperature Control

A fixing operation of the fixing device 100 will be described with reference to a control flow chart of (a) of FIG. 10 and a block diagram of a control system of (b) of FIG. 10. During a stand-by state of the fixing device 100, the lower-side belt assembly B is held at the spaced position of FIG. 5. The drive of the driving motor 301 is stopped, and electric energy supply to the IH heater 170 is also stopped.

The CPU 10 starts predetermined image forming sequence control on the basis of input of a print job start signal. With respect to the fixing device 100, at a predetermined control timing, the pressing motor 302 is driven via a motor driver 302D, and the pressing cam shaft 307 is driven a half turn, so that the lower-side belt assembly B is moved from the spaced position of FIG. 5 to the pressing position of FIG. 4. As a result, the fixing nip N is formed between the fixing belt 105 and the pressing belt 120 <S16-001>.

Next, the CPU 10 drives the driving motor 301 via a motor driver 301D to input the driving force into the drive input gear G. As a result, the driving roller 131 of the upper-side belt assembly A is driven as described above to start rotation of the fixing belt 105.

Further, a rotational force of the drive input gear G (FIG. 6) is also transmitted to the pressing belt 120 of the lower-side belt assembly B via a driving gear train (not shown), so that the pressing roller 121 is rotationally driven in the counterclockwise direction of an arrow in FIG. 4. With the rotation of the pressing roller 121 and by a frictional force with the rotating fixing belt 105, rotation of the pressing belt 120 is started in the counterclockwise direction of an arrow in FIG. 4 <S16-002>. The movement directions of the fixing belt 105 and the pressing belt 120 are the same at the fixing nip N and moving speeds thereof are also substantially the same.

Figure 10:
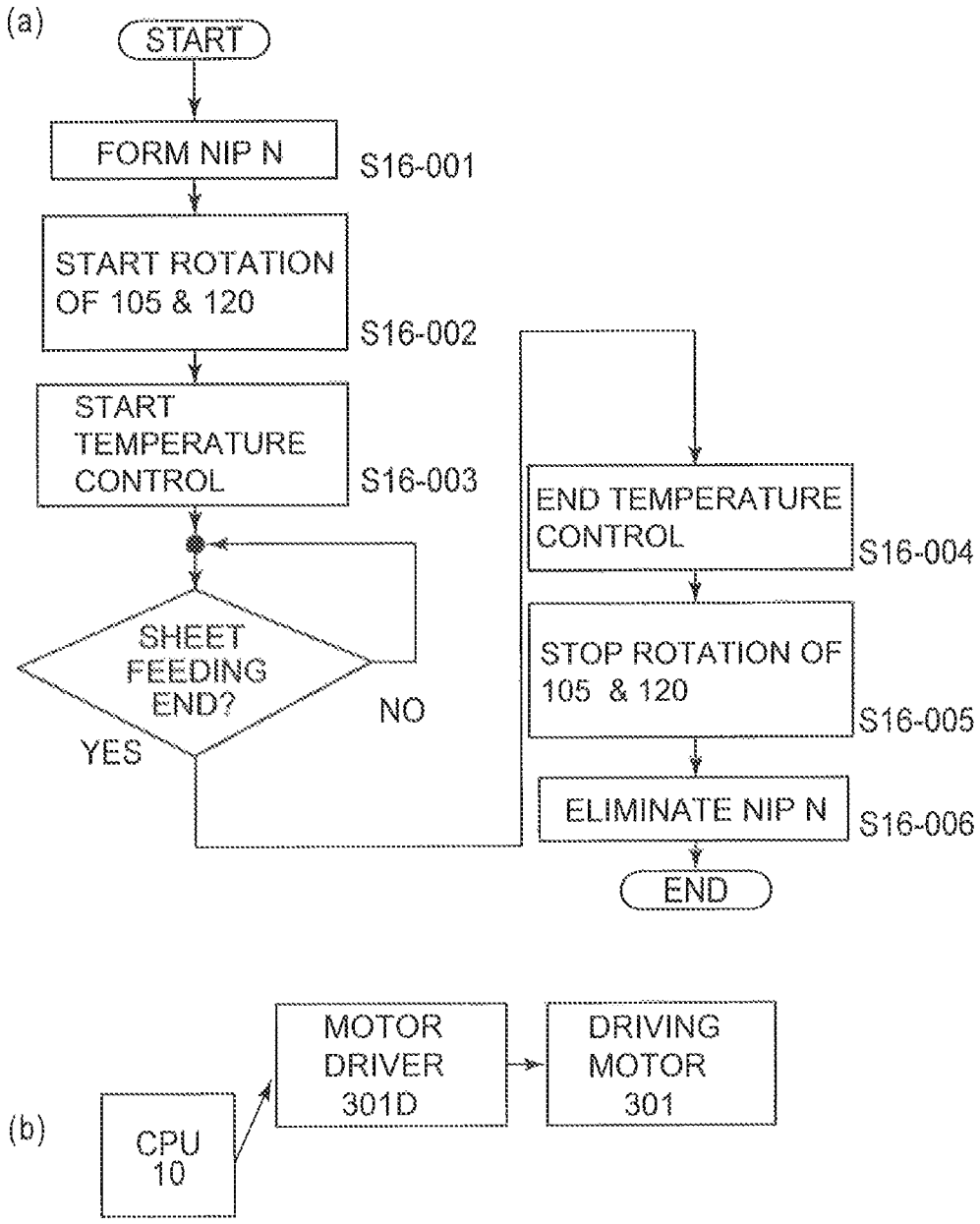
In FIG. 10, (a) is a fixing operation control flowchart, and (b) is a block diagram of a control system.

Next, the CPU 10 supplies electric power to the IH heater 170 via a heater controller 170C ((b) of FIG. 10) and a heater driver 170D to heat the rotating fixing belt 105 through electromagnetic induction heating, thus raising the fixing belt temperature to a predetermined target temperature to effect temperature control. That is, the CPU 10 starts the temperature control such that the temperature of the fixing belt 105 is raised to the target temperature ranging from 140° C. to 200° C. depending on a basis weight or type of the sheet S to be passed through the fixing device 100 and then is maintained at the target temperature <S16-003>.

Then, in a state in which the formation of the fixing nip N, the rotation of the fixing belt 105 and the pressing belt 120, and the temperature raising and temperature control of the fixing belt 105 are effected, the sheet S on which surface the unfixed toner image t (FIG. 4) is formed is guided from the image forming portion side into the fixing device 100. The sheet S is guided by an entrance guide 184 provided at a sheet entrance portion of the fixing device 100 to enter the fixing nip N which is the press-contact portion between the fixing belt 105 and the pressing belt 120. The entrance guide 184 is provided with a flag sensor 185 including a photo-interrupter, so that the flag sensor 185 detects passing timing of the sheet S.

The sheet S opposes the fixing belt 105 at its image-carrying surface and opposes the pressing belt 120 at its surface opposite from the image-carrying surface, and in this state, the sheet S is nipped and fed at the fixing nip N. Then, the unfixed toner image t is fixed as a fixed image on the sheet surface by heat of the fixing belt 105 and the nip pressure. The sheet S having passed through the fixing nip N is separated from the surface of the fixing belt 105 and comes out of the fixing device 100 from the sheet exit side, and then is fed and discharged onto a discharge tray 21 by a discharging roller pair 20 (FIG. 1).

Then, when the feeding of the sheet S in the print job of a predetermined single sheet or a plurality of successive sheets is ended, the CPU 10 ends the heating and temperature control of the fixing belt 105 and turns off the power supply to the IH heater 170 <S16-004>. Further, the driving motor 301 is turned off to stop the rotation of the fixing belt 101 and the pressing belt 120 <S16-005>.

Further, the CPU 10 drives the pressing motor 302 via the motor driver 302D to the pressing cam shaft a half turn, so that the lower-side belt assembly B is moved from the pressing position of FIG. 4 to the spaced position of FIG. 5. By this, the fixing nip N between the fixing belt 105 and the pressing belt 120 is eliminated <S16-006>. In this state, the CPU 10 waits for input of a subsequent print job start signal.

Figure 9:
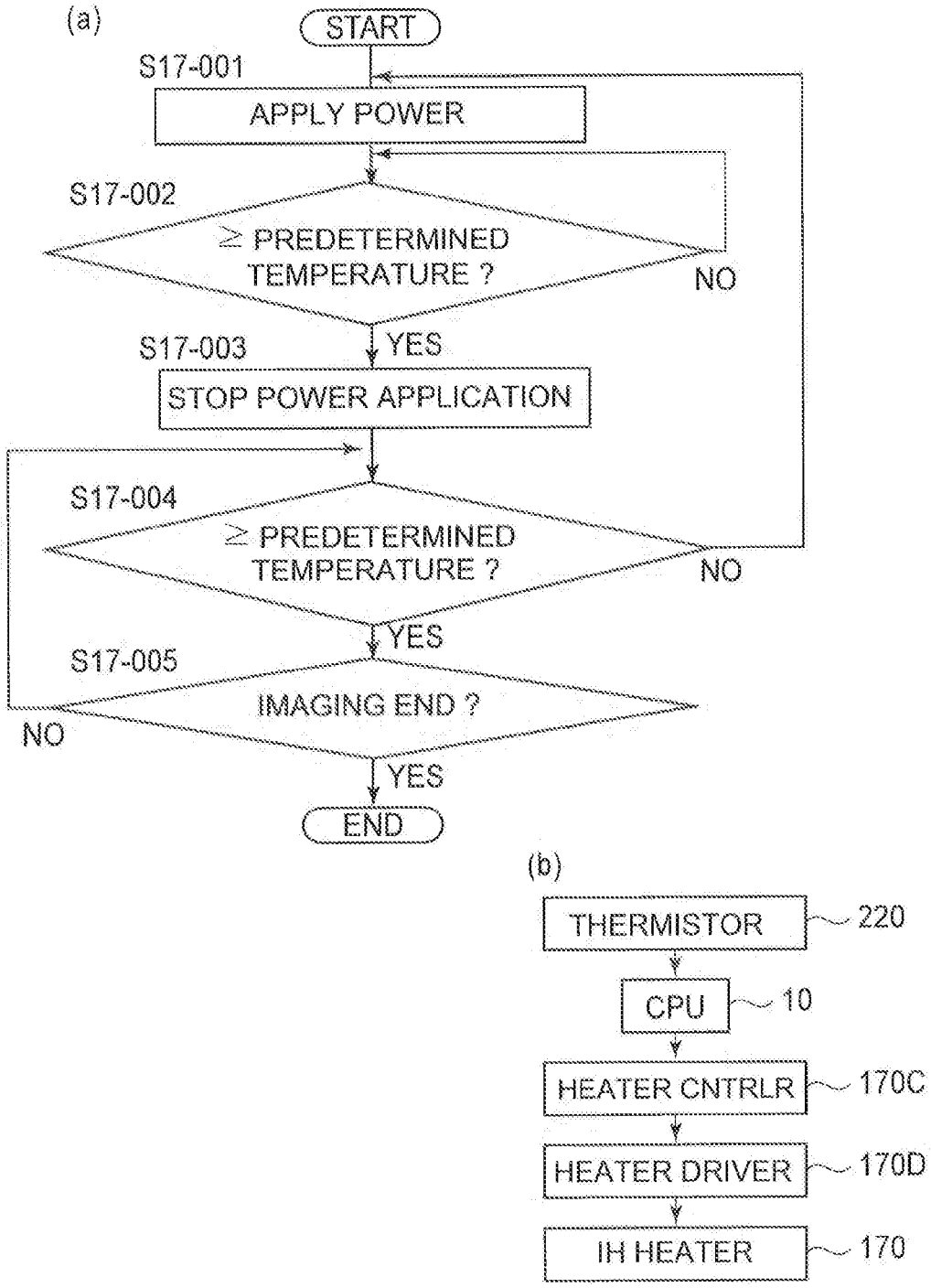
In FIG. 9, (a) is a fixing belt temperature control flowchart, and (b) is a block diagram of a control system.

Here, by a control flow chart of (a) of FIG. 9 and a block diagram of a control system of (b) of FIG. 9, temperature control of the fixing belt 105 will be described. In the upper-side belt assembly A, a thermistor 220 as a temperature detecting member for detecting the surface temperature of the fixing belt 105 is provided. The CPU 10 supplies the electric power to the IH heater 170 via the heater controller 170C and the heater driver 170D at predetermined control timing on the basis of the input of the print job start signal <S17-001>. The fixing belt 105 is heated in temperature through the electromagnetic induction heating by the IH heater 170.

The temperature of the fixing belt 105 is detected by the thermistor 220, and detection temperature information (electrical information on the temperature) is inputted into the CPU 10. The CPU 10 stops the supply of the electric power to the IH heater 170 when the detection temperature by the thermistor 220 is not less than a predetermined value (target temperature). Thereafter, the CPU 10 resumes, when the detection temperature by the thermistor 220 is lower than the predetermined value <NO of S17-004>, the supply of the electric power to the IH heater 170 is resumed <S17-001>.

By repetition of the above-described steps <S17-001> to <S17-004>, the fixing belt 105 is temperature-controlled and kept at the predetermined target temperature. Then, the above fixing belt temperature control is executed until the print job of the predetermined single sheet or the plurality of successive sheets is ended <S17-005>.

4) Belt Shift Control Mechanism

The fixing belt 105 generates a phenomenon that in a rotation process thereof, the fixing belt 105 moves so as to shift toward one side or the other side with respect to a widthwise direction perpendicular to the sheet feeding direction V (shift movement of the belt). Also the pressing belt 120 forming the fixing nip N in press-contact with the fixing belt 105 shifts and moves together with the fixing belt 105.

In this embodiment, this shift movement of the fixing belt 105 is stabilized within a predetermined shift range by swing-type shift control. The swing-type shift control is such a method that in the case where movement of a belt position from a widthwise central portion by a predetermined amount is detected, the steering roller 132 is tilted in an opposite direction to the shift movement direction of the fixing belt 105. By repeating this swing-type shift control, the fixing belt 105 periodically moves from one side to the other side in the widthwise direction, and therefore the shift movement of the fixing belt 105 can be controlled stably. That is, the fixing belt 105 is constituted so as to be reciprocable in the direction perpendicular to the feeding direction V of the sheet S.

In the upper-side belt assembly A, at a position toward the steering roller 132 on the left side (front side) of the fixing belt 105, a sensor portion (not shown) for detecting a fixing belt end portion position is provided. The CPU 10 detects the end portion position (belt shift movement position) of the fixing belt 105 by this sensor portion, and depending on that, rotates the stepping motor 155 in the normal rotational direction (CW) or the reverse rotational direction (CCW) by a predetermined number of rotations.

By this, via the above-described mechanisms 157, 152, 161, 151 of FIGS. 5 and 6, the left-side steering roller supporting arm 154 rotationally moves about the shaft 131*a* upward or downward by a predetermined control amount. In interrelation with this, a tilt of the steering roller 132 changes, so that the shift control of the fixing belt 105 is affected.

5) Fixing Belt Roughening Mechanism

Next, a roughening mechanism (surface property refreshing mechanism) for performing surface property refreshing of the fixing belt 105 will be described using FIG. 1. In this embodiment, above the driving roller 131 of the upper-side belt unit A, a roughening roller 400 as a rotatable rubbing member (roughening member) for refreshing (restoring) the surface property of the fixing belt 105 by rubbing (roughening) an outer surface of the fixing belt 105 is provided. This roughening roller is, as described above, effective in the case where a portion of the fixing belt contacting the edge portion of the sheet S is partly roughened at the surface thereof compared with another portion.

That is, the roughening roller rubs the fixing belt over substantially an entire region with respect to the longitudinal direction, whereby a surface roughness is made substantially the same between a portion where the surface is partly roughened and a portion where the surface is not partly roughened, so that a deterioration state is made inconspicuous. In this manner, the thing that makes the deterioration state inconspicuous is, in this embodiment, that the surface property is refreshed (restored). Specifically, in this embodiment, the surface of the fixing belt partly roughened to have a surface roughness Rz (according to JIS standard) of about 2.0 is restored to the surface roughness Rz of 0.5 or more and 1.0 or less by a roughening process (rubbing process) by such a roughening roller.

At this time, in the case where a difference in surface roughness Ra (according to JIS standard) between the portion of the fixing belt contacting the sheet edge portion and another portion is ΔRa, the process is performed so that ΔRa is changed from a state of about 0.3 to about 0.1 by the roughening process (rubbing process). In this way, in this embodiment, although the roller is called the roughening roller, the function of the roughening roller is that the surface roughness of the fixing belt 105 is maintained in a sufficiently low state for a long term. This leads to suppression of a lowering in glossiness of the image while suppressing uneven glossiness of the image.

The roughening roller 400 is rotatably supported via bearings (not shown) between a pair of left and right RF supporting arms 141 rotatably supported by a fixing shaft 142 fixed coaxially with each of the left and right upper-side plates 140 of a device casing. The roughening roller 400 is prepared by closely bonding abrasive grain toward a surface of a core metal formed of a stainless steel in 12 mm in diameter via an adhesive layer.

The roughening roller 400 may preferably use, as the abrasive grain provided on a cylindrical base material, the abrasive grain of #1000-#4000 in count (grain size) depending on a target glossiness of the image. An average particle size of the abrasive grain is about 16 μm in the case where the count (grain size) is #1000 and is about 3 μm in the case where the count (grain size) is #4000. The abrasive grain is alumina-based abrasive grain (popularly called "Alundum" or "Morundum"). The alumina-based abrasive grain is the abrasive grain which is industrially used most wisely, and is remarkably high in hardness compared with the surface of the fixing belt 105 and is excellent in abrasiveness since particles thereof have an acute shape. In this embodiment, the abrasive grain (7 μm in average particle size) of #2000 in count (grain size) is used.

Incidentally, in this embodiment, as the roughening roller 400, the roller prepared by closely bonding the abrasive grain toward the stainless steel-made core metal via the adhesive layer was described. However, the roughening roller 400 is not limited thereto, but may also be a roller obtained by subjecting the surface of the stainless steel-made core metal to a roughening process by blasting or the like so that Ra is 1.0 or more and 5.0 or less, preferably be about 2.0 or more and about 4.0 or less.

6) Contact-and-Separation Mechanism for Causing Roughening Roller to Contact and Separate In this embodiment, a contact-and-separation mechanism (moving mechanism) for moving the roughening roller toward and away from the fixing belt is provided. That is, the contact-and-separation mechanism for contacting the roughening roller with the fixing belt during an operation of the rubbing process while spacing (separating) the roughening roller from the fixing belt during a non-operation of the rubbing process is provided.

In the following, the contact-and-separation mechanism will be described specifically by FIG. 1A and FIG. 1B. The roughening roller is constituted so that shaft portions at longitudinal end portions of the roughening roller are pressed toward the fixing belt by a pressing mechanism. In this embodiment, the left and right RF supporting arms 141 (FIG. 1A) described later perform the function of this pressing mechanism. On an upper side of the left and right RF supporting arms 141, PF cams (eccentric cams) 407 (FIG. 1B) as the moving mechanism for moving the roughening roller toward and away from the fixing belt are provided, respectively.

Here, the left and right RF cams 407 are fixed to an RF cam shaft 408 (FIG. 1A) rotatably shaft-supported between the left and right upper-side plates 140 (FIG. 1A) of the device casing in the same shape with the same phase. RF spacing springs 405 (FIG. 1A) are stretched and disposed between arm end portions of the left and right RF supporting arms 141 in an opposite side from a side where the roughening roller is supported and the RF spacing shafts 406 fixed and secured to the left and right upper-side plates 140.

Figure 1A:
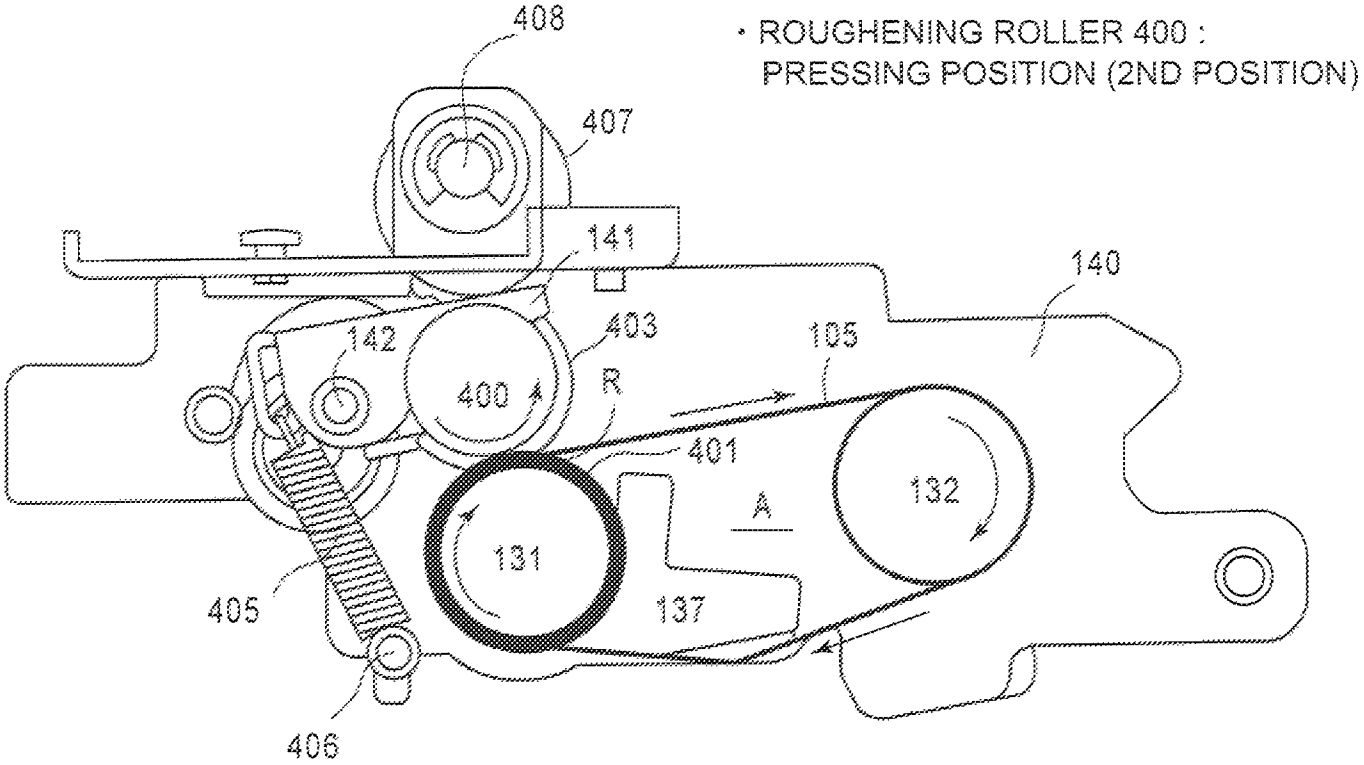
FIG. 1A is a cross-sectional right side view during a pressing state of a lower-side belt assembly B) of a principal part of a fixing device.
Figure 1B:
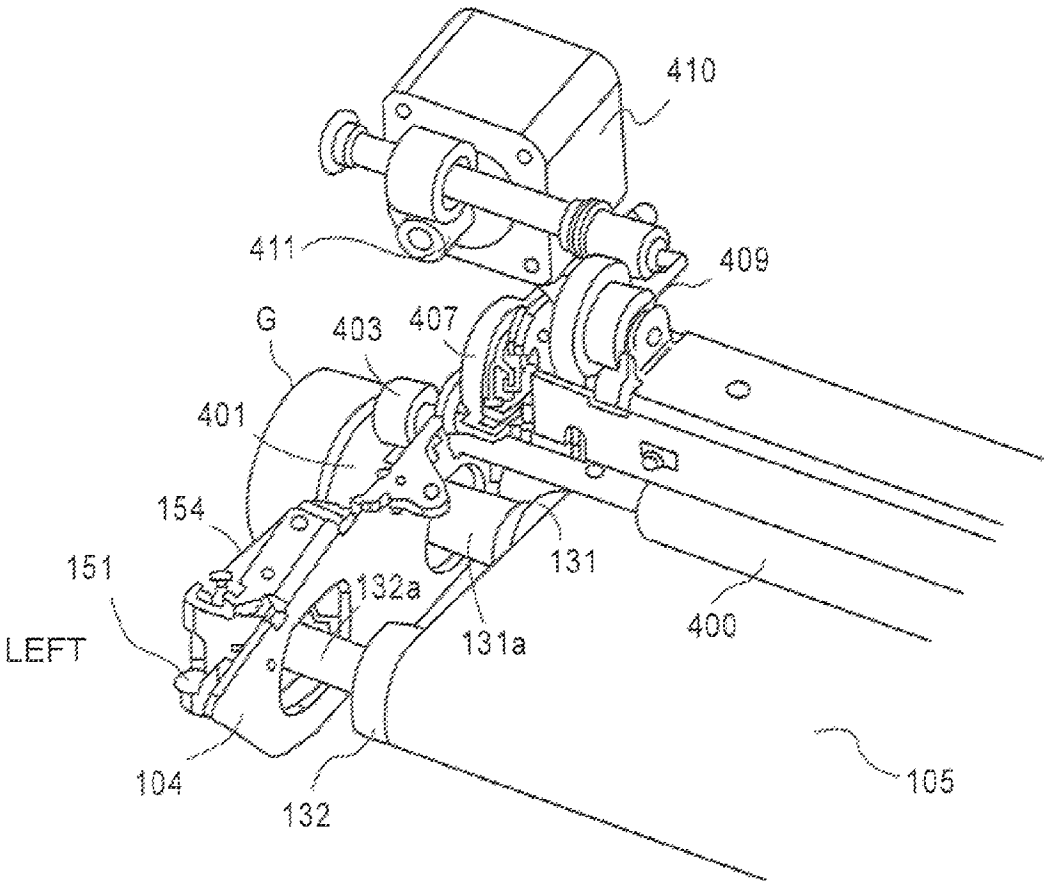
FIG. 1B is a perspective view of a roughening mechanism (surface property refreshing mechanism).

By tension of this RF spacing spring 405, the left and right RF supporting arms 141 are always rotated and urged about the fixing shaft 142 in a direction of raising the roughening roller 400, so that the upper arm surface is elastically pressed against the lower surface of the corresponding one of the refreshing cams 407 (FIG. 1B). Further, at a right side end portion of the RF cam shaft 408, an RF mounting and demounting gear 409 (FIG. 1B) is fixed. With this RF mounting and demounting gear 409, an RF motor gear 411 of an RF motor 410 engages.

In this embodiment, the left and right RF cams 407 usually stop in a first attitude having an angle of rotation where the largely protruded portion is directed upward as shown in FIGS. 4 and 5. During this state, the left and right RF supporting arms 141 correspond to the small protruded portions of the corresponding RF cams 407. For that reason, the roughening roller 400 is held at the spaced position spaced from the fixing belt 105 by a predetermined distance. That is, the roughening roller 400 is raised above the fixing belt 105 and does not act on the fixing belt 105.

The left and right RF cams 407 are rotated 180 degrees from the above-mentioned first attitude, and are changed in attitude to a second attitude having an angle of rotation where the largely protruded portion is directed downward, as shown in FIG. 1A, and are held in the second attitude. During this state, the left and right RF supporting arms 141 are pressed down about the fixing shaft 142 against the RF spacing springs 405 by the corresponding RF cams 407. Then, the roughening roller 400 contacts (abuts) the surface of the fixing belt 105 with a predetermined pressure at a belt extending portion of the driving roller 131, and is changed and maintained in position to the pressing position (contact position) where a roughening nip R is formed.

Further, an RF gear 403 fixed to an end portion of the roughening roller 400 engages with an RF driving gear 401 fixed to an end portion of the driving roller 131. By this, a rotational force of the driving roller 131 is transmitted to the roughening roller 400 via the RF driving gear 401 and the refreshing gear 403, so that the roughening roller 400 rotates in an opposite direction to the rotational direction of the fixing belt 105. That is, the roughening roller 400 provided with a rubbing layer at the surface thereof rotates in a width direction (a direction in which their surfaces move in the same direction) with a perpendicular speed difference relative to the fixing belt 105, and has the function for uniformly roughening the surface of the fixing belt 105 (surface smoothing function).

That is, the roughening roller 400 which is a rubbing member is a roller member rotating with the peripheral speed difference relative to the fixing belt 105. A positional change of the roughening roller 400 between the spaced position and the pressing position is made by changing the attitude of the left and right RF cams 407 between the first attitude and the second attitude as described above by the RF pressing motor 410 via the RF motor gear 411, the RF mounting and demounting gear 409 and the RF cam shaft 408. Incidentally, in FIG. 1A, the lower-side belt unit belt forming the fixing nip N by being pressed against the upper-side belt unit A is omitted.

Here, during the rubbing process of the fixing belt 105 (upper-side belt unit A) by the roughening roller 400, the lower-side belt unit B is not limited to the case where the lower-side belt unit B is in a contact state with the upper-side belt unit A, but may also be in a spaced state from the upper-side belt unit A.

Figure 11:
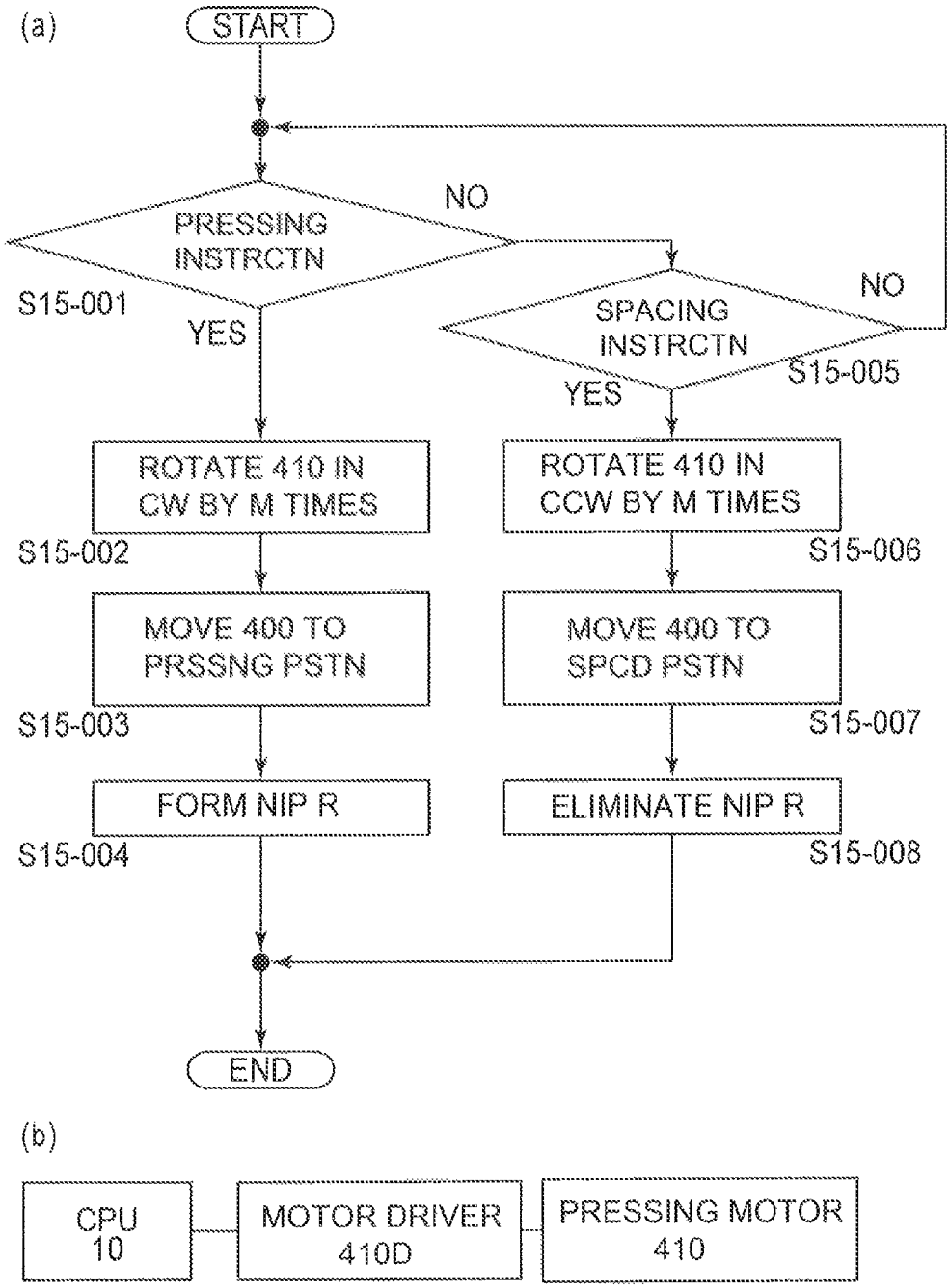
In FIG. 11, (a) is a control flowchart of a roughening mechanism, and (b) is a block diagram of a control system.

In FIG. 11, (a) is an operation control flowchart of the above-mentioned roughening mechanism. The left and right RF cams 407 of the roughening mechanism are, as described above, usually stopped in the first attitude having the angle of rotation where the largely protruded portion is directed upward as shown in FIGS. 4 and 5. That is, the roughening roller 400 is usually held at the spaced position in which the roughening roller 400 is spaced from the fixing belt 105 in a predetermined state.

The CPU 10 rotates, at predetermined pressing control timing <S15-001: pressing instruction>, the RF motor 410 in CW direction by M turns which is a predetermined number of rotations by the motor driver 410D <S15-002>. As a result, the left and right RF cams 407 are changed in attitude from the first attitude (FIGS. 4 and 5) to the second attitude (FIG. 1A), so that the roughening roller 400 is moved from the spaced position (first position) to the pressing position (second position) <S15-003>. By movement of the roughening roller 400 to the pressing position, the fixing belt 105 and the roughening roller 400 press-contact each other, so that the roughening nip R is formed <S15-004>.

Then, the CPU 10 rotates, at predetermined spacing control timing <S15-005: spacing instruction>, the RF motor 410 in CCW direction by M turns which is a predetermined number of rotations by the motor driver 410D <S15-006>. As a result, the left and right RF cams 407 are returned in attitude from the second attitude (FIG. 1A) to the first attitude (FIGS. 4 and 5), so that the roughening roller 400 is moved from the pressing position to the spaced position <S15-007>. By movement of the roughening roller 400 to the pressing position, the roughening nip R where the fixing belt 105 and the roughening roller 400 press-contacted each other is eliminated <S15-008>.

As described above, the roughening roller 400 contacts the fixing belt 105 and forms the roughening member R, so that the roughening roller 400 rotates. By this, refreshing of the surface property of the fixing belt 105 is made, but in a process in which the roughening process (rubbing process) is made, shavings (cuttings) of the surface fixing belt layer can generate at the pressing nip. Here, the generated shavings accumulate at the roughening nip and gradually impair a roughening effect and thus can lower an efficiency of the roughening process (rubbing process).

In order to prevent the lowering in efficiency of the roughening process (rubbing process) by the shavings and paper powder on the fixing belt surface layer generated by this roughening roller, during a series of operations of the roughening process (rubbing process) based on a single roughening process execution instruction, the roughening roller is intermittently and repetitively contacted to the fixing belt. That is, during the series of operations of the roughening process (rubbing process) based on the single roughening process execution instruction, the roughening roller 400 is repetitively reciprocated plural times between the pressing position and the spaced position as described below. Accordingly, also when the roughening roller is positioned in the spaced position during this roughening process, a constitution is employed so that the fixing process is not performed (so that the sheet is not introduced into the nip N).

Figure 12:
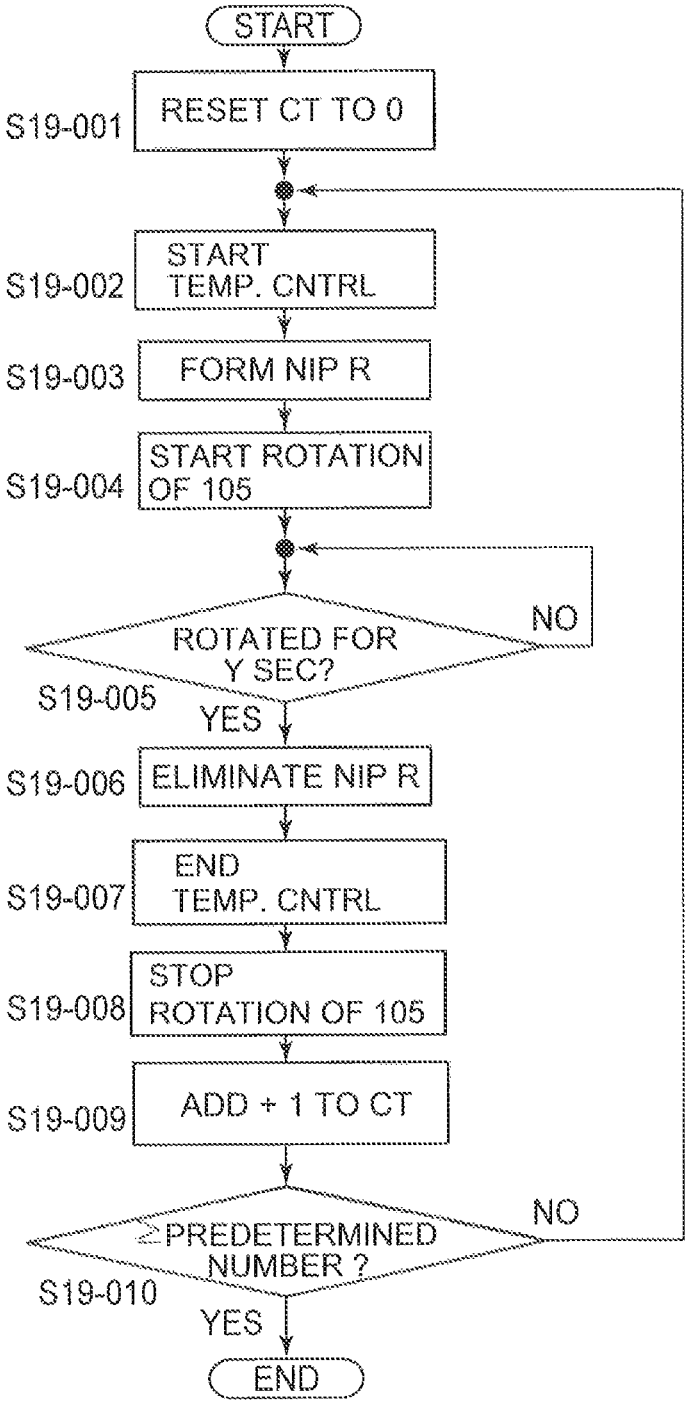
FIG. 12 is a surface property refreshing operation flowchart.

In the following, this series of operations of the roughening process (rubbing process) will be described using FIG. 12. When the roughening process (rubbing process) is started, a roughening operation counter CT is reset to 0, and a value of the roughening operation counter CT is stored in a memory Z<S19-001>. Then, a temperature of the upper belt 105 is controlled to a temperature for performing the roughening process (rubbing process) by the IH heater 170<S19-002>. The temperature control at this time is executed in accordance with the flowchart of FIG. 9.

When the temperature control is started, the roughening roller 400 is press-contacted to the fixing belt 105, so that the roughening nip R is formed <S19-003>. Here, formation of the roughening nip R is made by <S15-001>-<S15-004> of FIG. 11. Then, the roughening operation is performed for a predetermined time Y sec (In this embodiment, a contact time is 3 sec. In 3 sec, the fixing belt rotates one turn or more) while rotating the fixing belt 105 <S19-005>.

After the rotation for Y sec, the roughening roller is moved to the spaced position (in this embodiment, a spacing time is 5 sec), so that the roughening nip R is eliminated <S19-006>, and the temperature control by the IH heater 170 is ended and the fixing belt 105 is stopped. Here, the elimination of the roughening nip R is made by <S15-005>-<S15-008> of FIG. 11.

Figure 13:
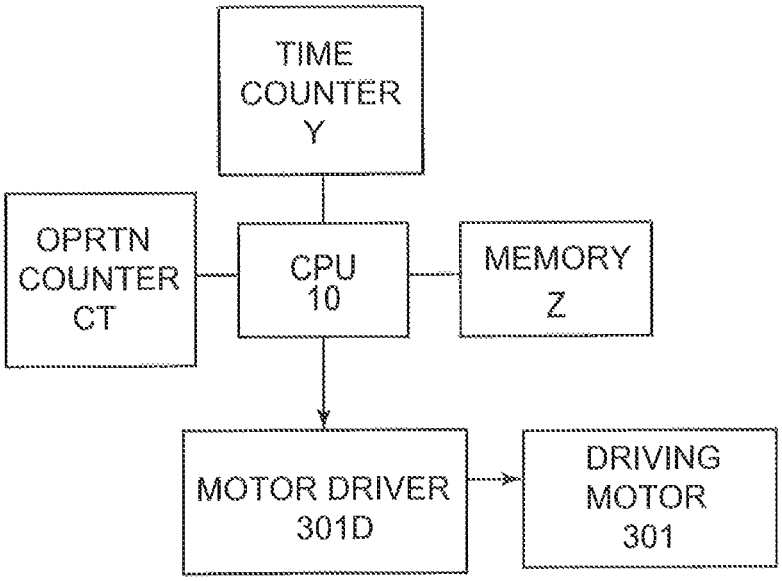
FIG. 13 is a block diagram of a control system.

Then, as shown in FIG. 13, +1 is added to the value of the roughening operation counter CT stored in the memory Z, and a first roughening operation is ended <S19-009>. Here, <S19-002>-<S19-009> are repetitively performed (6 times in this embodiment) until a present value of the roughening operation counter CT is a predetermined value. That is, in this embodiment, during the rubbing process, an operation of contact of the roughening roller 400 with the fixing belt 105 for 3 sec and an operation of spacing for 5 sec performed after the contacting operation are alternately repeated plural times. The above operations are the series of operations of the roughening process (rubbing process), and by this series of operations of the roughening process (rubbing process), improvement in refreshing efficiency of the surface property can be achieved.

In this embodiment, the series of operations of the roughening process (roughness) including the press-contact and spacing operation times of the roughening roller 400 is controlled so as to be completed in 60 sec. Here, a surface property refreshing effect for the fixing belt 105 in the case where the operation in which the roughening roller 400 is contacted to the fixing belt 105 for 3 sec and thereafter is spaced from the fixing belt 105 for 5 sec is repeated plural times as in this embodiment and in the case of a comparison example in which the contact time is continued for 30 sec without executing the spacing operation during the rubbing process is shown in FIG. 14.

Figure 14:
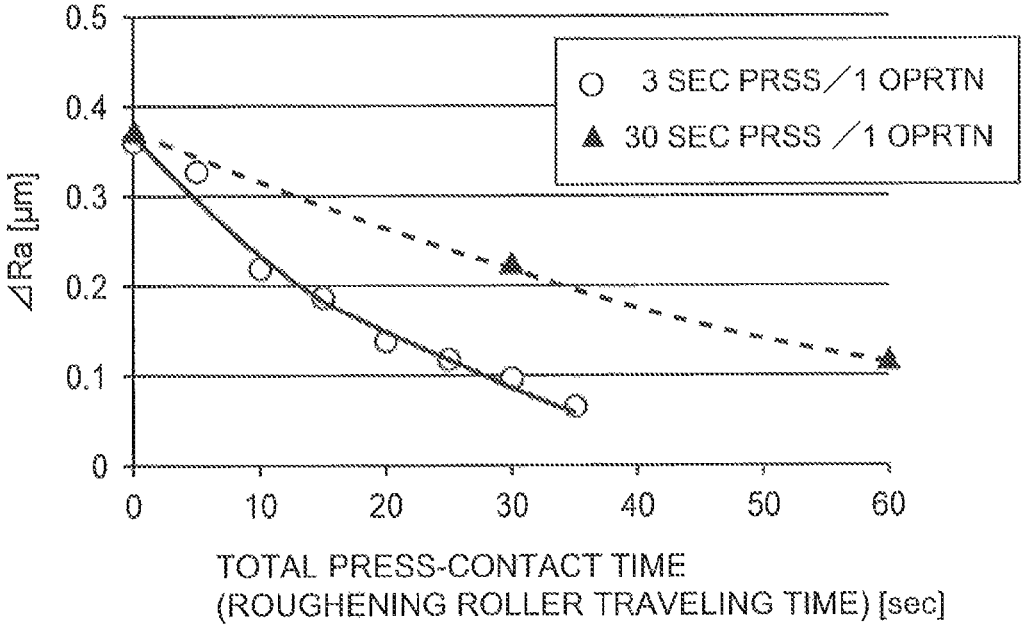
FIG. 14 is a surface property refreshing effect illustration according to a number of times of contact and separation of a roughening roller.

In FIG. 14, the abscissa is a total press-contact time (roughening roller traveling time) which is a cumulative value of the contact (press-contact) time of the roughening roller 400 with the fixing belt 105, and the ordinate shows a difference ΔRa in surface roughness Ra between a portion of the fixing belt contacting the sheet edge portion and another portion. Here, as ΔRa is a small value, it means that a resultant state is a state in which the surface property is refreshed (restored). As a time in which the roughening roller 400 rotates in a state in which the roughening roller 400 contacts (press-contacts) the fixing belt 105 becomes long, the surface property refreshing effect lowers, and therefore by effecting the contact and spacing plural times in a short time as in this embodiment, the refreshing of the surface property of the fixing belt 105 can be made more efficiently.

Next, timing when the operation goes to the surface property refreshing operation for the fixing belt 105 by the roughening roller 400 will be described using (a) and (b) of FIG. 15. As shown in (b) of FIG. 15 which is a block diagram, in this embodiment, the CPU (executing portion) 10 counts a number of times of image formation which is a number of sheets S subjected to the fixing process by the fixing device 100 in this embodiment, in execution of a print job (image forming job) by a counter (counting portion) W, and stores an integrated value thereof in the memory Z.

Then, in the case where the integrated value reaches a predetermined number N (3000 sheets in this embodiment), the surface property refreshing operation for the fixing belt 105 by the roughening roller 400 is executed during a non-fixing process by waiting for an end of the print job being executed or by interrupting the execution of the print job (fixing process). When the surface property refreshing operation is ended, the integrated value stored in the memory Z is reset to 0. In the case where the print job is interrupted, the surface property refreshing operation for the fixing belt 105 is executed, and thereafter a remaining part of the print job is resumed.

In (a) of FIG. 15, the surface property refreshing operation flow is shown as follows. When the integrated value of a number of sheets subjected to passing (through the fixing device) is not less than a predetermined number N of sheets subjected to passing <S18-001>, the CPU 10 confirms the end of the print job being executed or temporarily interrupts the print job <S18-002>. Then, the CPU 10 starts the surface property refreshing operation <S18-003>. Further, the counter is reset to 0. When the surface property refreshing operation is ended, the operation is in a state waiting for a subsequent print job or in the state waiting for the subsequent print job after the interrupted printer job is resumed and the end thereof <S18-004>.

7) Temperature Setting During Roughening Process

As mentioned above, the roughening roller 400 press-contacts the fixing belt 105 and forms the roughening nip R, and the refreshing of the surface property of the fixing belt 105 is made by rotating the roughening roller 400. However, as a time of rubbing rotation of the fixing belt 105 with the roughening roller 400 by the roughening process (rubbing process) (hereinafter, called a traveling time) goes, a roughening effect gradually lowers by the shavings of the fixing belt surface layer or by an abrasion deterioration of the roughening roller 400 itself. This will be described using FIG. 18.

Figure 18:
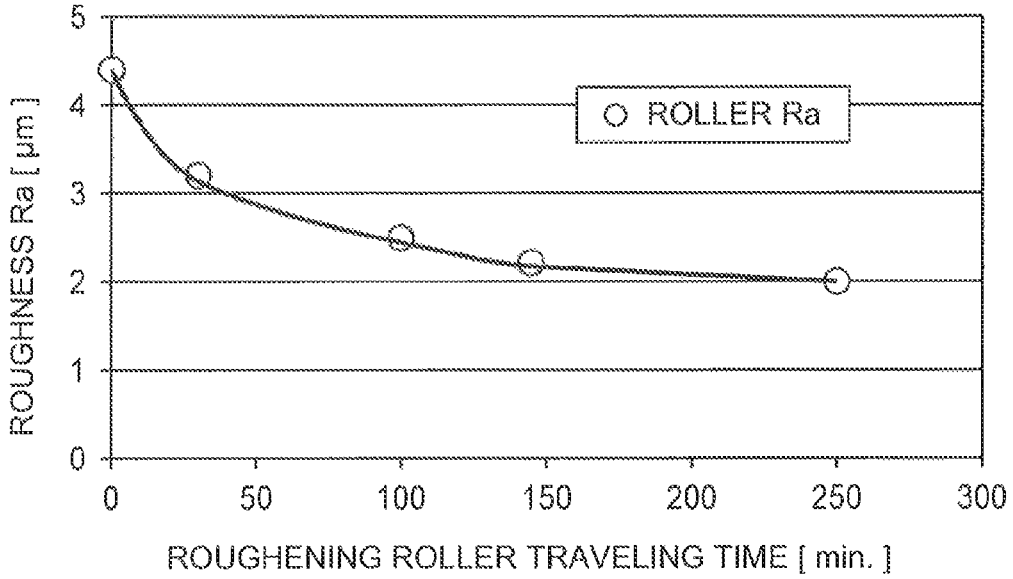
FIG. 18 is a progression illustration of a roughness Ra with a traveling time of the roughening roller.

FIG. 18 shows progression of the roughness Ra with a lapse of a traveling time of the roughening roller 400, wherein the surface roughness Ra of the roughening roller 400 is taken as the ordinate and the traveling time of the roughening roller 400 is taken as the abscissa. The surface roughness Rz of the roughening roller 400 (initial Ra is about 4.5 in this embodiment) which was enough to obtain the roughening effect at an initial stage of durability lowers with the lapse of the traveling time (i.e., the number of times of image formation), so that there is a possibility that a sufficient roughening effect cannot be obtained (Ra of about 2.0 in this embodiment).

Figure 19:
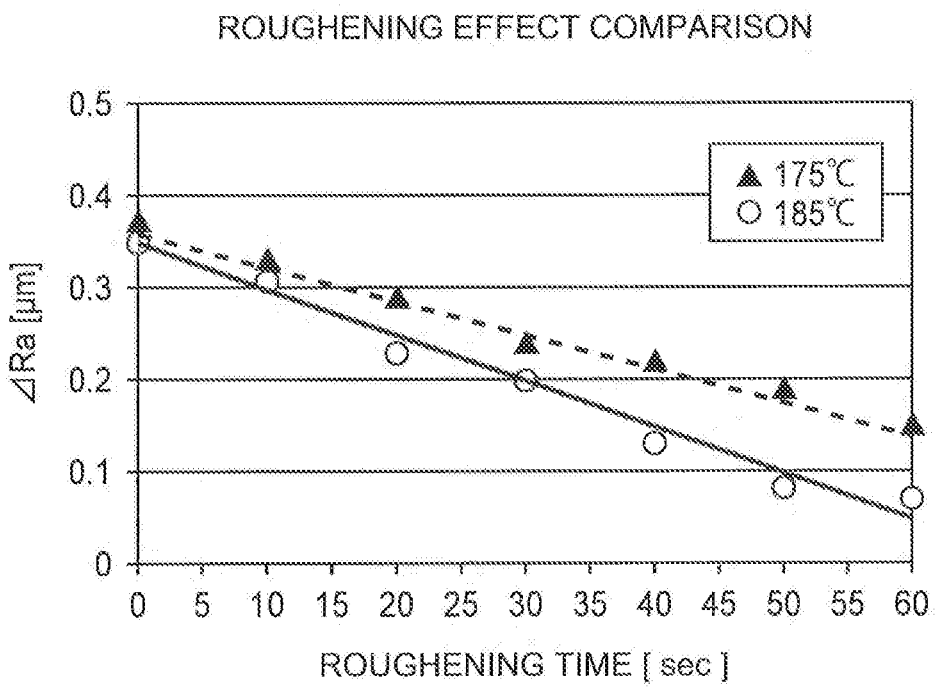
FIG. 19 is a surface property refreshing effect illustration according to (temperature) control temperatures during a roughening process.

In order to solve this, control is effected so that the temperature of the fixing belt 105 during the roughening process (rubbing process) is increased with an increasing traveling time of the roughening roller 400. This will be described using FIG. 19. The abscissa of FIG. 19 is a rubbing process time in which the roughening roller 400 rotates in a press-contact state with the fixing belt 105 and performs refreshing of the surface property of the fixing belt 105. The ordinate of FIG. 19 shows the difference ΔRa in surface roughness Ra between the fixing belt portion contacting the sheet edge portion and another portion, and means that the fixing belt is in a state in which the surface property is refreshed with a smaller value of ΔRa.

In the case where the roughening process (rubbing process) is performed in each of the case where the fixing belt 105 temperature during the rubbing process is 175° C. and the case of 185° C., a higher temperature provides a higher surface property refreshing effect for the fixing belt 105. However, when the temperature is made high from an initial state in which the roughening effect is sufficiently obtained, the surface property of the roughening roller 400 is transferred onto the fixing belt surface layer. For this reason, extreme changes in glossiness of the image between before and after the roughening process (rubbing process) may occur, and therefore control is effected so that the roughening process (rubbing process) is performed by increasing the temperature of the fixing belt 105 with a lowering in surface roughness Ra of the roughening roller 400.

Figure 20:
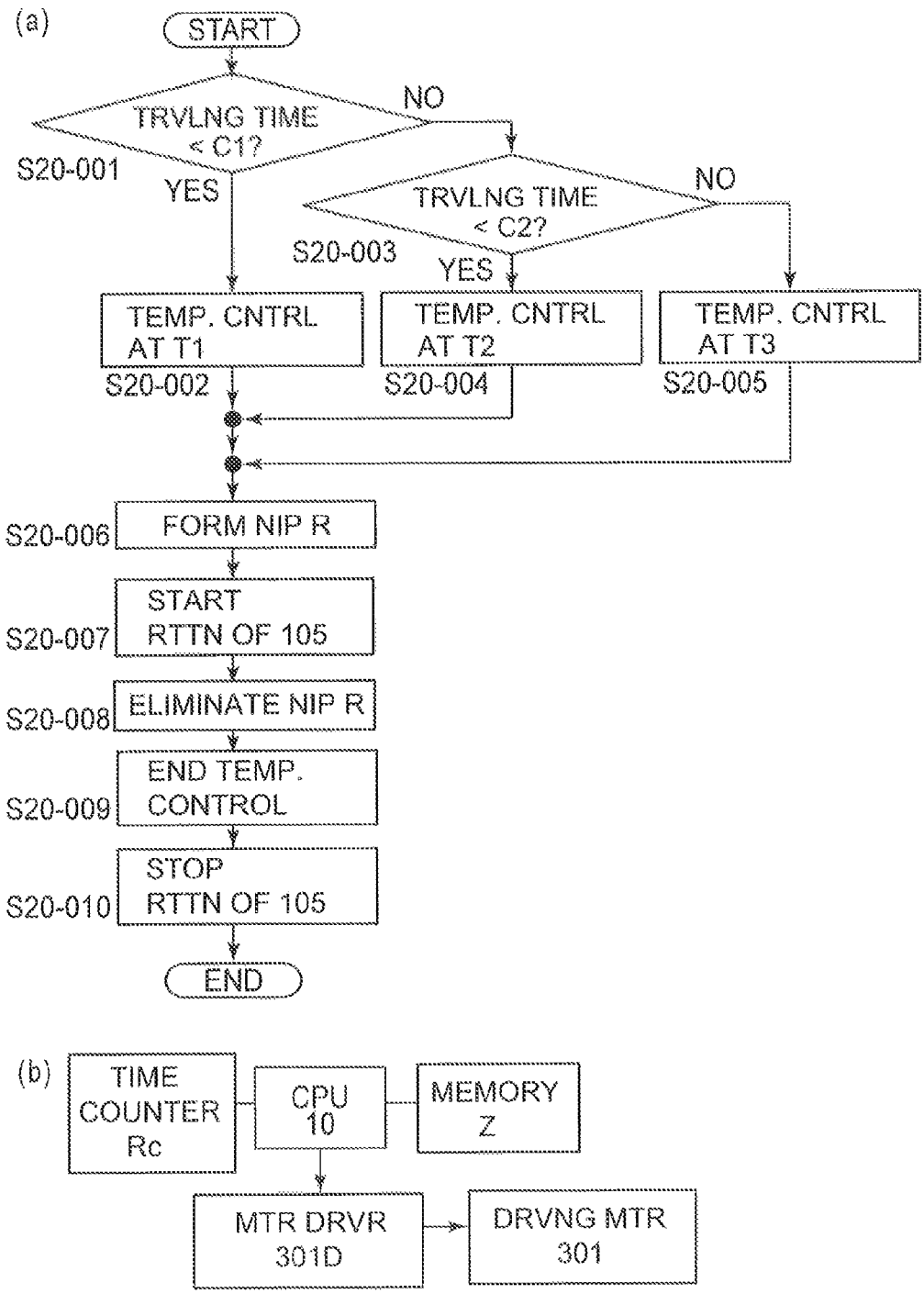
In FIG. 20, (a) is a surface property refreshing operation flowchart, and (b) is a block diagram of a control system.

In the following, this roughening process (rubbing process) operation will be described using FIG. 20. When the roughening process (rubbing process) is started, the roughening roller traveling time stored in the memory Z of the CPU 10 is referred to. If this is less than a certain value C1 (2100 sec in this embodiment), the fixing belt 105 is temperature-controlled to a temperature T1 (175° C. in this embodiment) by the IH heater 170 <S20-002>. If the roughening roller traveling time is C1 or more and less than C2 (6000 sec in this embodiment), the fixing belt 105 is temperature-controlled to a temperature T2 (180° C. in this embodiment) by the IH heater 170 <S20-004>.

If the roughening roller traveling time is C2 or more, the fixing belt 105 is temperature-controlled to a target temperature T2 (185° C. in this embodiment) by the IH heater 170 <S20-005>. That is, the control temperature is increased depending on an increase in cumulative rubbing time. The temperature control at this time is made in accordance with FIG. 9. When the temperature control is started, the roughening roller 400 is contacted (press-contacted) to the fixing belt 105, so that the roughening nip R is formed <S20-006>. Here, formation of the roughening nip R is made by <S15-001>-<S15-004> of FIG. 11.

Then, the fixing belt 105 is rotated, and the roughening operation is performed (<S20-007> in this embodiment). The roughening operation time at this time is added to a traveling time counter Rc ((b) of FIG. 20), and is used for changing the control temperature of the fixing belt 105 during a subsequent roughening process (rubbing process) (in this embodiment, the roughening operation time is 60 sec).

When the roughening operation is performed for a predetermined time (60 sec in this embodiment), the roughening roller 400 is moved to the spaced position, so that the roughening nip R is eliminated <S20-008>, and the temperature control by the IH heater 170 is ended and the fixing belt 105 is stopped. Here, elimination of the roughening nip R is made by <S15-005>-<S15-008> of FIG. 11. By the roughening process (rubbing process) described above, the refreshing of the surface property of the fixing belt 105 can be performed. Incidentally, in the above, the target temperature of the fixing belt is controlled depending on the traveling time of the roughening roller 400, but for example, may also be controlled depending on a cumulative number of times of image formation (cumulative number of sheets subjected to image formation) counted by a counter W. Specifically, a target temperature during the rubbing process executed in the case where the cumulative number of sheets subjected to image formation is not less than a predetermined number of sheets (e.g., 30,000 sheets) is made higher than a target temperature during the rubbing process executed in the case where the cumulative number of sheets subjected to image formation is less than the predetermined number of sheets.

Next, timing when the operation goes to the surface property refreshing operation for the fixing belt 105 by the roughening roller 400 will be described using (a) of FIG. 15. In this embodiment, as shown in (b) of FIG. 15 which is a block diagram, the CPU 10 counts a number of sheets S subjected to the fixing process by the fixing device 100, in execution of a print job by the counter W, and stores an integrated value thereof in the memory Z.

Then, in the case where the integrated value reaches a predetermined number N (3000 sheets in this embodiment), the surface property refreshing operation for the fixing belt 105 by the roughening roller 400 is executed after an end of the print job being executed or by interrupting the execution of the print job (fixing process). When the surface property refreshing operation is ended, the integrated value stored in the memory Z is reset to 0. In the case where the print job is interrupted, the surface property refreshing operation for the fixing belt 105 is executed, and thereafter a remaining part of the print job is resumed.

Figure 15:
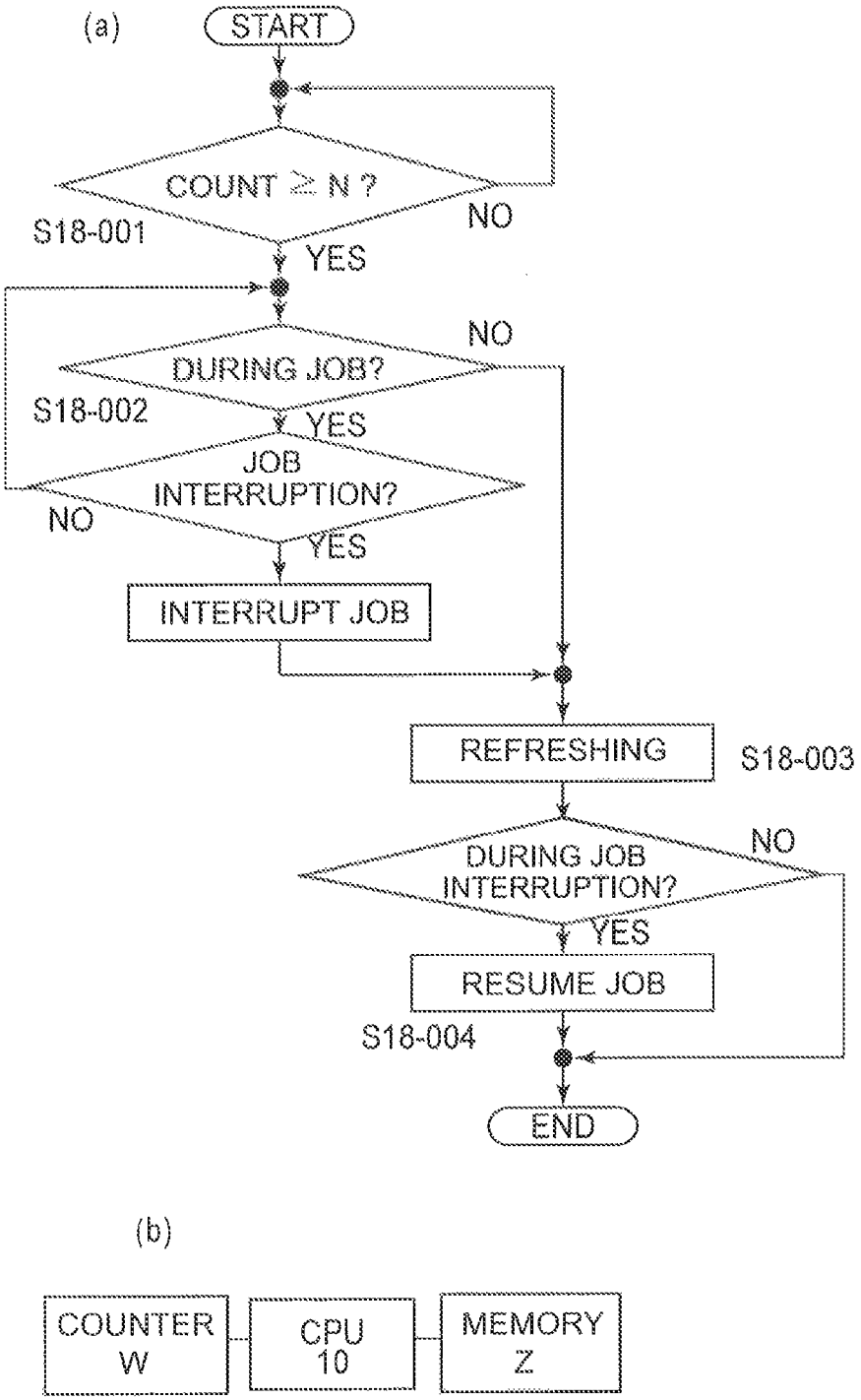
In FIG. 15, (a) is a control flowchart of a surface property refreshing operation (roughening operation), and (b) is a block diagram of a control system.

In (a) of FIG. 15, when the integrated value of a number of sheets subjected to passing (through the fixing device) is not less than a predetermined number N of sheets subjected to passing <S18-001>, the CPU 10 waits for the end of the print job being executed or temporarily interrupts the print job <S18-002>, and then, starts the surface property refreshing operation <S18-003>. Further, the counter is reset to 0. When the surface property refreshing operation is ended, the operation is in a state waiting for a subsequent print job or in the state waiting for the subsequent print job after the interrupted printer job is resumed and the end thereof <S18-004>.

8) Air Blowing Mechanism

As mentioned above, the fixing belt 105 is subjected to rubbing by movement of the roughening roller 400 to the pressing position, so that the refreshing of the surface property thereof is made. In this case, the shavings of the fixing belt surface layer can generate at the roughening nip. The shavings remain on the fixing belt, so that the effect of the roughening process (rubbing process) can be impaired.

In order to prevent the shavings of the fixing belt surface layer by the roughening roller 400 from remaining on the fixing belt, the shavings of the fixing belt surface layer during the roughening process are diffused using an air blowing mechanism. In the following, a shaving diffusion constitution using this air blowing mechanism will be specifically described.

Figure 16:
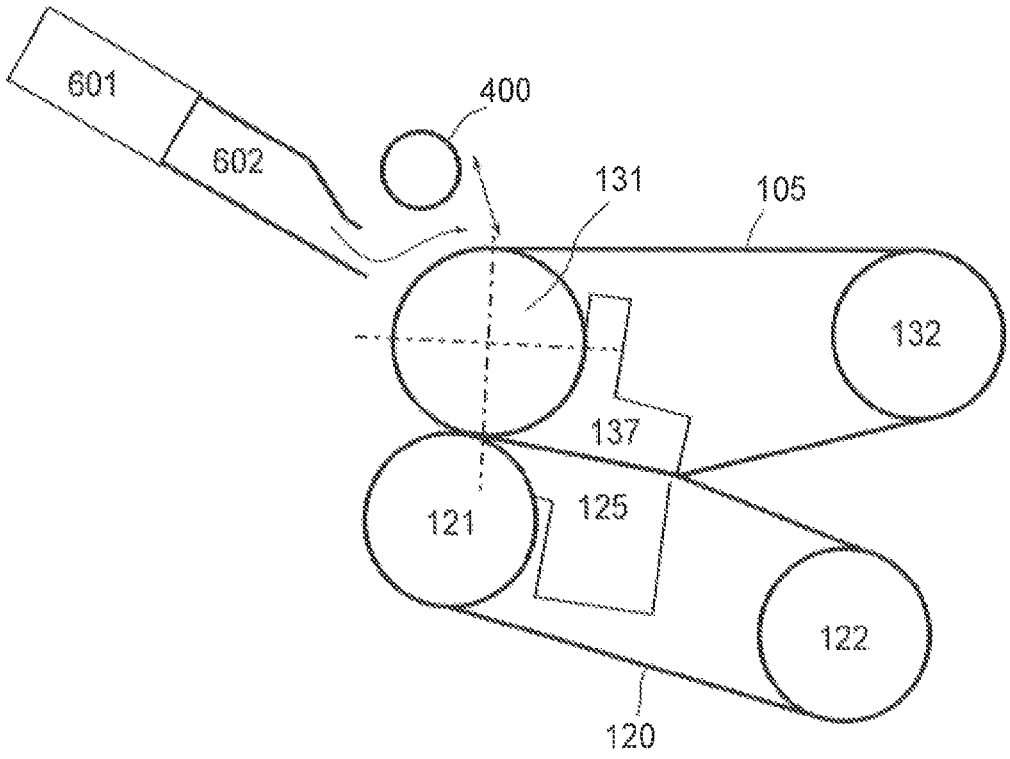
FIG. 16 is a schematic view of an air blowing constitution for diffusion of shavings.
Figure 17:
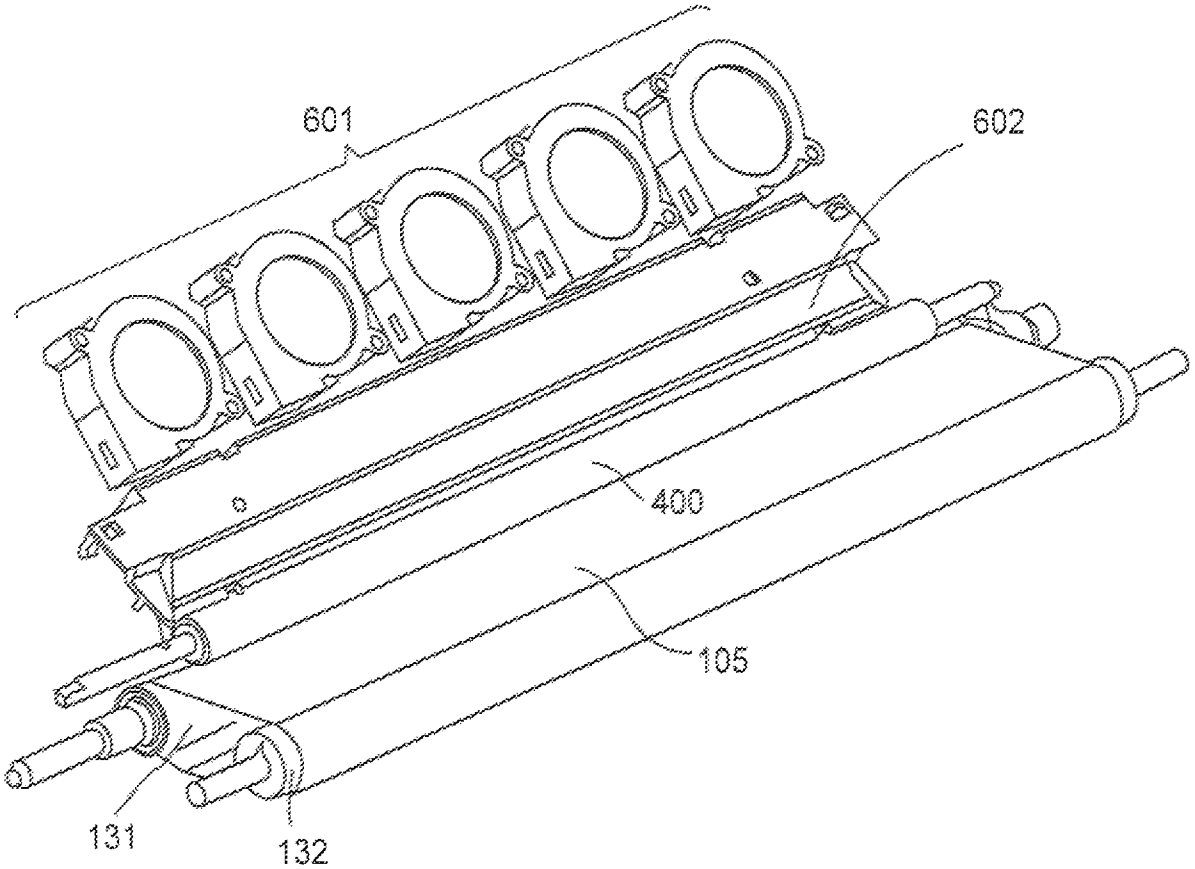
FIG. 17 is a perspective view of the air blowing constitution for the diffusion of the shavings.

FIG. 16 is a schematic view of the air blowing mechanism in this embodiment, and FIG. 17 is a perspective view of the air blowing mechanism. The air blowing mechanism includes a fan 601 and a duct 602. An operation of the fan 601 is controlled by the CPU 10 which is a controlling device. The fan 601 sends (blows) the air via the duct 602 toward the roughening nip (contact portion) R with the fixing belt 105 when the roughening roller 400 moves to the pressing position, so as to be capable of sending the air into an entire longitudinal region (entire widthwise region) toward the fixing belt 105.

In this embodiment, when the roughening roller 400 moves from the position where the roughening roller 400 contacts the fixing belt 105 to the spaced position, the air is blown from the fan 601 toward the neighborhood of the roughening nip R at a wind speed Vw (e.g., 10 m/s) via the duct 602. By this, the shavings of the fixing belt surface layer generating in a stripe shape during the roughening operation are diffused. That is, the shavings of the fixing belt surface layer by the roughening roller 400 is prevented from remaining on the fixing belt, so that it becomes possible to suppress a lowering in refreshing efficiency of the surface property caused due to impairment of a subsequent roughening operation.

In this embodiment, during the rubbing process, the roughening roller 400 is disposed opposed to the driving roller 131 which is one of the plurality of supporting rollers for supporting the fixing belt 105 from an inner surface (of the fixing belt 105). Then, the roughening roller 400 is contacted (press-contacted) to the fixing belt 105 toward the driving roller 131, so that the roughening operation is performed.

Further, the fan 601 effects air blowing from an upstream side toward a downstream side with respect to the rotational direction of the fixing belt, whereby the diffusion of the shavings capable of remaining on the fixing belt is made. Here, when the roughening roller moves at least from the pressing position (contact position) to the spaced position, the air blowing by the fan 601 is made. Incidentally, also after the roughening roller moves from the pressing position to the spaced position, subsequently, the air blowing by the fan 601 is made for a predetermined time. If the air blowing is made in such a manner, the shaving can be diffused further, and is preferable.

Further, when the air blowing by the fan 601 is started at timing earlier than start timing of movement of the roughening roller from the pressing position to the spaced position, the diffusion can be made to some extent in advance, and therefore is preferable. The fan 601 stops an air blowing process after the roughening roller moves to the spaced position and performs the air blowing process for the predetermined time and before the roughening roller moves to the contact position. Control of the air blowing process is effected by the CPU 10.

In the above, the embodiment according to the present invention was described, but within a scope of a concept of the present invention, the above-described various constitutions can be replaced with well-known constitutions. For example, in the above-described embodiment, as an object to be subjected to the rubbing process by the roughening roller, the fixing belt was described as an example, but the present invention is not limited thereto and may further similarly be applicable to also an example in which the pressing belt is subjected to the rubbing process by the roughening roller. That is, not only with respect to the pressing belt, the contact of the roughening roller with the pressing belt and the spacing the roughening roller from the pressing belt are repeated during the operation of the rubbing process but also the spacing of the roughening roller from the pressing belt is made. In the case where such a pressing belt is subjected to the rubbing process by the roughening roller, the rubbing process is particularly effective when the images are formed on both surfaces of the sheet.

Further, in the above-described embodiment, control was effected so that the roughening process (rubbing process) is performed by increasing the temperature of the fixing belt 105, depending on the increase in cumulative rubbing time of the fixing belt by the roughening roller, with the lowering in surface roughness of the roughening roller, but the present invention is not limited thereto. That is, with the lowering in surface roughness of the roughening roller, during the operation of the rubbing process by the roughening roller, an increase in ratio of a spacing time to a contact time may also be made, and this increase may also be made in combination with the above-described temperature increase.

Further, in the above-described embodiment, control may also be effected so that the roughening process (rubbing process) is performed by increasing the temperature of the roughening roller, depending on the increase in cumulative rubbing time of the fixing belt by the roughening roller, with the lowering in surface roughness of the roughening roller. That is, one or both of the fixing belt and the pressing roller may also be increased in temperature.

Further, in the above-described embodiment, an example in which the surface property refreshing operation for the fixing belt 105 by the roughening roller 400 after the fixing process is performed on sheets of a predetermined number in the fixing device 100 (after the number of sheets reached a predetermined value) was described, but the present invention is not limited thereto. For example, the surface property refreshing operation for the fixing belt 105 by the roughening roller 400 may also be performed after the number of only specific sheets is counted to a predetermined value, before a print job when a sheet size is switched, or before a print job of sheets of a specific species. Alternatively, the surface property refreshing operation for the fixing belt 105 may also be executed at proper timing by an operation/instruction of a user through a printer operating portion 24 (FIG. 2) in a print stand-by state. Further, in the above-described embodiment, an example in which the control temperature of the fixing belt during the roughening process (rubbing process) is changed depending on the traveling time of the roughening roller was described, but the present invention is not limited thereto. For example, in place of the traveling time of the roughening roller, depending on a number of sheets subjected to the fixing process, the temperature may also be switched.

Further, in the above-described embodiment, the fixing device using the fixing belt and the pressing belt was described as an example. However, the present invention is not limited thereto, but may also be similarly applicable to the case where a fixing roller is used instead of the fixing belt, and the case where in place of the pressing belt, a pressing roller or a pad which has a small surface friction coefficient and which is non-rotationally fixed is used.

Further, in the above-described embodiment, the heating portion using the electromagnetic induction heating type was described, but the present invention is not limited thereto and is similarly applicable to also the case where a heating portion, such as a halogen heater, or another type is used. Specifically, for example, in this case, the heating portion such as the halogen heater is disposed inside the driving roller 131 or the pressing roller 121.

Further, in the above-described embodiment, an example in which the roughening process by the roughening roller is executed with respect to the fixing belt was described, but in place thereof, with respect to the pressing belt, and embodiment in which the roughening process is executed may also be employed. Further, an embodiment in which the roughening roller is provided for each of the fixing belt and the pressing belt and each of the fixing belt and the pressing belt is subjected to the roughening process may also be employed.

Further, in the above-described embodiment, as an example of the image heating apparatus, the fixing device for fixing the unfixed toner image on the sheet was described, but the present invention is not limited thereto and is similarly applicable to also a device for heating and pressing the toner image fixed on the sheet in order to improve glossiness of the image.

INDUSTRIAL APPLICABILITY

According to the present invention, there is provided an image heating apparatus which is the image heating apparatus using a rotatable rubbing member and which is capable of suppressing a lowering in rubbing power thereof caused by an image forming operation.

The invention claimed is:

1. An image heating apparatus comprising:

first and second rotatable members configured to form a nip for heating a toner image on a sheet;

a rotatable rubbing member configured to rub an outer surface of said first rotatable member;

a moving mechanism configured to move said rotatable rubbing member toward and away from said first rotatable member; and a controller configured to control said moving mechanism to execute a rubbing operation by said rotatable rubbing member, wherein when said controller executes a single rubbing operation, said controller alternately executes a first process for contacting said rotatable rubbing member with said first rotatable member and a second process for spacing said rotatable rubbing member from said first rotatable member a plurality of times.

2. An image heating apparatus according to claim 1, further comprising an air blowing mechanism configured to blow air toward a contact position of said rotatable rubbing member with said first rotatable member, wherein said air blowing mechanism blows the air when the second process is executed during the rubbing operation.

3. An image forming apparatus according to claim 1, wherein said rotatable rubbing member is provided with an abrasive grain of #1000-#4000 in count at a surface thereof.

4. An image heating apparatus according to claim 1, wherein a surface roughness Ra of said rotatable rubbing member is 1.0 or more and 5.0 or less.

5. An image heating apparatus according to claim 1, wherein said rotatable rubbing member executes the rubbing operation so that a surface roughness Rz of said first rotatable member is 0.5 or more and 1.0 or less.

6. An image heating apparatus according to claim 1, wherein said first rotatable member is an endless belt rotatably supported by a plurality of supporting rollers at an inner surface thereof, and wherein said rotatable rubbing member contacts said endless belt so as to sandwich said endless belt between said rotatable rubbing member and one of said supporting rollers.

7. An image heating apparatus according to claim 1, wherein said first rotatable member is provided on a side where said first rotatable member contacts the toner image on the sheet.

8. An image forming apparatus comprising:

an image forming portion configured to form a toner image on a sheet;

first and second rotatable members configured to form a nip for heating the toner image formed on the sheet by said image forming portion;

a rotatable rubbing member configured to rub an outer surface of said first rotatable member;

a moving mechanism configured to move said rotatable rubbing member toward and away from said first rotatable member;

a counter configured to count a number of times of image formation; and a controller configured to control said moving mechanism to execute a rubbing operation by said rotatable rubbing member depending on an output of said counter, wherein when said controller executes a single rubbing operation, said controller causes said moving mechanism to alternately execute a first process for contacting said rotatable rubbing member with said first rotatable member and a second process for spacing said rotatable rubbing member from said first rotatable member a plurality of times.

9. An image forming apparatus according to claim 8, further comprising an air blowing mechanism configured to blow air toward a contact position of said rotatable rubbing member with said first rotatable member, wherein said air blowing mechanism blows the air when the second process is executed during the rubbing operation.

10. An image forming apparatus according to claim 8, further comprising a heating portion configured to heat said first rotatable member so as to maintain a target temperature, wherein the target temperature of said first rotatable member during the execution of the rubbing operation when the number of times of image formation is a predetermined number or more is made higher by said heating portion than the target temperature of said first rotatable member during the execution of the rubbing operation when the number of times of image formation is less than the predetermined number.

11. An image forming apparatus according to claim 8, further comprising a heating portion configured to heat said first rotatable member so as to maintain a target temperature, wherein the target temperature of said first rotatable member during the execution of the rubbing operation when a cumulative time of contact of said rotatable rubbing member with said first rotatable member is a predetermined time or more is made higher by said heating portion than the target temperature of said first rotatable member during the execution of the rubbing operation when the cumulative time of contact is less than the predetermined time.

12. An image forming apparatus according to claim 8, wherein said rotatable rubbing member is provided with an abrasive grain of #1000-#4000 in count at a surface thereof.

13. An image forming apparatus according to claim 8, wherein a surface roughness Ra of said rotatable rubbing member is 1.0 or more and 5.0 or less.

14. An image forming apparatus according to claim 8, wherein said rotatable rubbing member executes the rubbing operation so that a surface roughness Rz of said first rotatable member is 0.5 or more and 1.0 or less.

15. An image forming apparatus according to claim 8, wherein said counter counts a number of sheets subjected to the image formation.

16. An image forming apparatus according to claim 8, wherein said first rotatable member is an endless belt rotatably supported by a plurality of supporting rollers at an inner surface thereof, and wherein said rotatable rubbing member contacts said endless belt so as to sandwich said endless belt between said rotatable rubbing member and one of said supporting rollers.

17. An image forming apparatus according to claim 8, wherein said first rotatable member is provided on a side where said first rotatable member contacts the toner image on the sheet.

18. An image forming apparatus according to claim 10, wherein said heating portion includes a coil configured to generate a magnetic flux for heating said first rotatable member through electromagnetic induction heating.

19. An image forming apparatus according to claim 8, wherein said controller causes said moving mechanism to execute the rubbing operation when the number of times of image formation is a predetermined number or more.

20. An image forming apparatus according to claim 10, wherein said controller causes said moving mechanism to execute the rubbing operation after waiting for an end of an image forming job when the number of times of image formation reaches the predetermined number during the image forming job.

* * * * *